US012611009B2

(12) United States Patent
Case et al.

(10) Patent No.: US 12,611,009 B2
(45) Date of Patent: Apr. 28, 2026

(54) BLADDERS, FOOTWEAR UPPERS INCLUDING BLADDERS, AND ARTICLES OF FOOTWEAR INCLUDING BLADDERS IN THE UPPER

(71) Applicant: NIKE, Inc., Beaverton, OR (US)

(72) Inventors: Patrick R. Case, Beaverton, OR (US); Yoon Jeong Choi, Portland, OR (US); James Molyneux, Portland, OR (US); Colin Runkle, Portland, OR (US); Bryan K. Youngs, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/024,734

(22) Filed: Jan. 16, 2025

(65) Prior Publication Data

US 2025/0151852 A1 May 15, 2025

Related U.S. Application Data

(63) Continuation of application No. 18/076,127, filed on Dec. 6, 2022, now Pat. No. 12,232,566.
(Continued)

(51) Int. Cl.
*A43B 23/02* (2006.01)
*A43B 7/20* (2006.01)
(Continued)

(52) U.S. Cl.
CPC ..... *A43B 23/029* (2013.01); *A43B 7/20* (2013.01); *A43B 23/26* (2013.01); *A43C 1/04* (2013.01); *A43C 11/20* (2013.01)

(58) Field of Classification Search
CPC ..... A43C 1/04; A43C 11/00; A43C 11/20; A43B 23/029; A43B 23/26; A43B 7/20
(Continued)

(56) References Cited

U.S. PATENT DOCUMENTS 1,216,795 A * 2/1917 Gause ..... A43B 7/06 36/3 R
2,230,915 A 2/1941 Spiro
(Continued)

FOREIGN PATENT DOCUMENTS

WO 90/04323 A2 5/1990

OTHER PUBLICATIONS

Reebok Pump Running Girl's Shoes Size 6.5" mmahhally.com (Accessed Apr. 26, 2021), https://mmahhally.com/indes.php? main_page=product_info&products_id=211495.
(Continued)

*Primary Examiner* — Marie D Bays
(74) *Attorney, Agent, or Firm* — Banner & Witcoff, Ltd.

(57) ABSTRACT

Footwear uppers and articles of footwear including such uppers include: (a) a first lateral lace-engaging component; (b) a first medial lace-engaging component; and (c) a bladder. The bladder includes: (i) a tongue and/or instep chamber having a first surface and a second surface opposite the first surface, (ii) a first heel and/or ankle support chamber, and (iii) a first fluid line placing the first heel and/or ankle support chamber in fluid communication with the tongue and/or instep chamber. A lace engages the first lateral lace-engaging component and the first medial lace-engaging component such that a first portion of the lace extends across the first surface. The lace may apply a force to the tongue and/or instep chamber, and this force may move fluid from the tongue and/or instep chamber to the first heel and/or ankle support chamber to provide additional support for the heel and/or ankle.

20 Claims, 17 Drawing Sheets

Related U.S. Application Data

(60) Provisional application No. 63/286,763, filed on Dec. 7, 2021, provisional application No. 63/286,793, filed on Dec. 7, 2021.

(51) Int. Cl.
*A43B 23/26* (2006.01)
*A43C 1/04* (2006.01)
*A43C 11/20* (2006.01)

(58) Field of Classification Search
USPC ..... 36/50.1, 54
See application file for complete search history.

(56) References Cited

U.S. PATENT DOCUMENTS

| | | | | |
|---|---|---|---|---|
| 2,357,980 | A | 9/1944 | Spiro | |
| 2,638,690 | A * | 5/1953 | Bullard, III | A43B 5/0407 36/117.6 |
| 3,299,543 | A | 1/1967 | Merritt | |
| 3,372,495 | A | 3/1968 | Finn | |
| 4,132,016 | A | 1/1979 | Vaccari | |
| 4,928,405 | A | 5/1990 | Spademan | |
| 5,113,599 | A | 5/1992 | Cohen et al. | |
| 5,158,767 | A * | 10/1992 | Cohen | A43B 23/029 36/114 |
| 5,253,435 | A | 10/1993 | Auger et al. | |
| 5,257,470 | A | 11/1993 | Auger et al. | |
| 5,348,530 | A | 9/1994 | Grim et al. | |
| 5,444,926 | A * | 8/1995 | Allen | A43B 5/0405 36/29 |
| 5,893,219 | A | 4/1999 | Smith et al. | |
| 5,987,779 | A | 11/1999 | Litchfield et al. | |
| 6,014,823 | A | 1/2000 | Lakic | |
| 6,128,837 | A | 10/2000 | Huang | |
| 6,408,542 | B1 | 6/2002 | Shepherd | |
| 6,460,197 | B2 | 10/2002 | Huang | |
| 6,655,050 | B1 | 12/2003 | Lowe | |
| 7,204,041 | B1 | 4/2007 | Bailey, Sr. et al. | |
| 7,278,445 | B2 | 10/2007 | Marvin et al. | |
| 7,478,488 | B1 | 1/2009 | Davis et al. | |
| 8,065,821 | B1 | 11/2011 | Reid | |
| 9,114,052 | B2 | 8/2015 | Avitable et al. | |
| 9,119,441 | B2 * | 9/2015 | Frappier | A43B 5/16 |
| 9,351,536 | B2 | 5/2016 | Schindler et al. | |
| 9,380,832 | B2 | 7/2016 | Smith et al. | |
| 9,687,045 | B2 * | 6/2017 | Leary | A43B 7/1495 |
| 9,775,406 | B2 | 10/2017 | Connell et al. | |
| 10,051,919 | B2 | 8/2018 | Leary et al. | |
| 10,251,450 | B2 | 4/2019 | Marvin et al. | |
| 10,405,607 | B2 | 9/2019 | Pauk et al. | |
| 10,798,988 | B2 | 10/2020 | Brown | |
| 10,842,229 | B2 | 11/2020 | Mou et al. | |
| 2002/0029496 | A1 | 3/2002 | Morle | |
| 2004/0003517 | A1 | 1/2004 | Marvin et al. | |
| 2005/0028404 | A1 | 2/2005 | Marvin et al. | |
| 2009/0044427 | A1 | 2/2009 | Shepherd et al. | |
| 2014/0173932 | A1 | 6/2014 | Bell | |
| 2016/0249706 | A1 | 9/2016 | Leary et al. | |
| 2017/0035148 | A1 | 2/2017 | Marvin et al. | |
| 2017/0360155 | A1 * | 12/2017 | Leary | A43B 23/081 |
| 2018/0110286 | A1 | 4/2018 | Vuong | |
| 2019/0110557 | A1 | 4/2019 | Hobson et al. | |
| 2019/0142112 | A1 | 5/2019 | Ramsay et al. | |
| 2019/0246742 | A1 | 8/2019 | Cooper | |
| 2020/0189171 | A1 | 6/2020 | Chan et al. | |
| 2021/0244128 | A1 | 8/2021 | Costa et al. | |
| 2023/0115950 | A1 | 4/2023 | Suzuki | |
| 2023/0141325 | A1 | 5/2023 | Case et al. | |
| 2023/0147306 | A1 | 5/2023 | Case et al. | |
| 2023/0172315 | A1 | 6/2023 | Case et al. | |
| 2023/0172316 | A1 | 6/2023 | Case et al. | |

OTHER PUBLICATIONS

Nike Air Zoom Pegasus 37 Review doctorsofrunning.com (Aug. 11, 2020), https://web.archive.org/web/20200811034136/https://www.doctorsofrunning.com/2020/05/nike-zoom-pegasus-37-review.html.

Nike LeBron 18 blog. eastbay.com (Mar. 9, 2021), https://blog.eastbay.com/category/best-of/.

The Nike Vapor Cage 4: Durability, Stability & Comfort, tennistopia.com (Dec. 8, 2019), https://www.tennistopia.com/blogs/tennis-reviews-comparisons-news-articles/nike-air-zoom-vapor-cage-r/.

Mar. 14, 2023 (WO) International Search Report and Written Opinion—App PCT/US2022/080922, 11 pages.

Mar. 27, 2023 (WO) International Search Report and Written Opinion—App PCT/US2022/080916, 9 pages.

* cited by examiner

BLADDERS, FOOTWEAR UPPERS INCLUDING BLADDERS, AND ARTICLES OF FOOTWEAR INCLUDING BLADDERS IN THE UPPER

RELATED APPLICATION DATA

This application is a continuation of U.S. patent application Ser. No. 18/076,127 filed Dec. 6, 2022 and entitled "Bladders, Footwear Uppers Including Bladders, and Articles of Footwear Including Bladders in the Upper," which application is a U.S. Non-Provisional Application based on and claiming priority to (a) U.S. Provisional Patent Appln. No. 63,286,763 filed Dec. 7, 2021 and entitled "Bladders, Footwear Uppers Including Bladders, and Articles of Footwear Including Bladders in the Upper" and (b) U.S. Provisional Patent Appln. No. 63,286,793 filed Dec. 7, 2021 and entitled "Bladders, Footwear Uppers Including Bladders, and Articles of Footwear Including Bladders in the Upper." Each of U.S. patent application Ser. No. 18/076,127, U.S. Provisional Patent Appln. No. 63,286,763, and U.S. Provisional Patent Appln. No. 63,286,793 is entirely incorporated herein by reference.

FIELD OF THE INVENTION

The present invention relates to bladders for footwear uppers, footwear uppers including the bladders, articles of footwear including the bladders, and/or methods of making and using such bladders, uppers, and/or articles of footwear. In some aspects of this technology, the bladders will include: (a) one or more bladder chambers and one or more fluid lines configured to move fluid to locations to provide support for a wearer's foot, e.g., heel and/or ankle support and/or (b) one or more lace eyestay supports and/or other lace-engaging components for engaging a shoelace.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

SUMMARY

This Summary introduces some general concepts relating to this technology in a simplified form. The concepts are further described in the Detailed Description below. This Summary is not intended to identify key features or essential features of the invention.

Aspects of this technology relate to bladders for footwear uppers, footwear uppers including the bladders, articles of footwear including the bladders, and/or methods of making and using such bladders, uppers, and/or articles of footwear, e.g., of the types described and/or claimed below and/or of the types illustrated in the appended drawings. In some aspects of this technology, footwear uppers will include one or more bladder chambers at an instep area of the upper, e.g., to moderate the feel of the footwear securing system; to engage a shoelace; and/or to supply fluid to other areas (e.g., heel and/or ankle areas) for support, fit, and/or comfort.

Additional or alternative aspects of this technology relate to footwear uppers incorporating bladders in which the bladders include: (a) one or more bladder chambers and in some examples one or more fluid lines configured to move fluid (e.g., from the instep or tongue area of the upper when the footwear is secured to a wearer's foot) to locations to provide support for a wearer's foot (e.g., for heel and/or ankle support), and/or (b) lace eyestay supports and/or other lace-engaging components (e.g., flexible strands forming a loop or other lace-engaging member) for engaging a shoelace. At least some footwear uppers in accordance with aspects of this technology may include a shoelace that applies force to a major surface of one or more of the bladder chambers to move fluid from the bladder chamber(s) (e.g., located at an instep or tongue area of the footwear upper) to one or more other locations (e.g., one or more heel and/or ankle support chambers). Additionally or alternatively, force for moving fluid as described above may be applied as a user moves (e.g., bends the foot at the instep area of the footwear when stepping, jumping, etc.) irrespective of whether a shoelace is present and/or tightened around a wearer's foot. Such bladders, footwear uppers, and articles of footwear may operate to move fluid in a pump-free manner (i.e., no pump is used with such products).

Still some additional or alternative aspects of this technology relate to bladders, e.g., for inclusion in footwear uppers, that include: (a) a first thermoplastic sheet; (b) a second thermoplastic sheet facing the first thermoplastic sheet; and (c) an outer perimeter seam sealing the first thermoplastic sheet to the second thermoplastic sheet. The first and second thermoplastic sheets may constitute portions of a single sheet of thermoplastic material, e.g., folded over on at least one edge. The outer perimeter seam defines a sealed interior volume (e.g., a bladder chamber) between the first thermoplastic sheet and the second thermoplastic sheet. In some examples of this technology, this outer perimeter seam extends continuously to form the sealed interior volume to include: (i) a fluid supply chamber having a first major surface formed by the first thermoplastic sheet, (ii) a first heel and/or ankle support chamber, and (iii) a first fluid line connecting the fluid supply chamber and the first heel and/or ankle support chamber through the sealed interior volume. In some examples, at least a first side edge portion of the outer perimeter seam may include a first lace-engaging opening defined through it. Additionally or alternatively, the bladder may define a bladder chamber that underlies at least a portion of a footwear securing system (e.g., shoelaces, etc.) at an instep area of the footwear upper to moderate force applied to a wearer's instep by the securing system. This instep-based bladder chamber may form at least a portion of the fluid supply chamber.

Additionally or alternatively, in some examples of this technology, the outer perimeter seam of the bladder may extend to form the sealed interior volume to include: (i) one or more fluid supply chambers having at least a first major surface formed by the first thermoplastic sheet, (ii) one or more heel and/or ankle support chambers, and (iii) one or more fluid lines connecting the fluid supply chamber(s) and the one or more heel and/or ankle support chambers through the sealed interior volume. In some examples, at least a first side edge portion of the outer perimeter seam may include a first lace-engaging opening defined through it. In use, fluid may move from the fluid supply chamber(s) to at least one heel and/or ankle support chamber (via at least one fluid line and optionally via two or more fluid lines) to increase fluid volume and/or pressure in the heel and/or ankle support chamber(s). The increased fluid volume and/or pressure provides additional support for the heel and/or ankle area(s) of a wearer's foot and/or improved comfort and/or fit by eliminating excess space in the shoe interior. The sealed interior volume of the bladder may contain a fixed mass of fluid (formed as a "closed" system in which fluid is not added or removed). The fluid may move in the sealed interior volume without the need of a pump (e.g., without a manual, mechanical, and/or electronic pump device).

While aspects of this technology are described in terms of bladders, footwear uppers including such bladders, and articles of footwear including such bladders, additional aspects of this technology relate to methods of making such bladders, footwear uppers, and/or articles of footwear and/or methods of using such bladders, footwear uppers, and/or articles of footwear, e.g., to provide heel and/or ankle support and/or to improve comfort and/or fit.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1A:
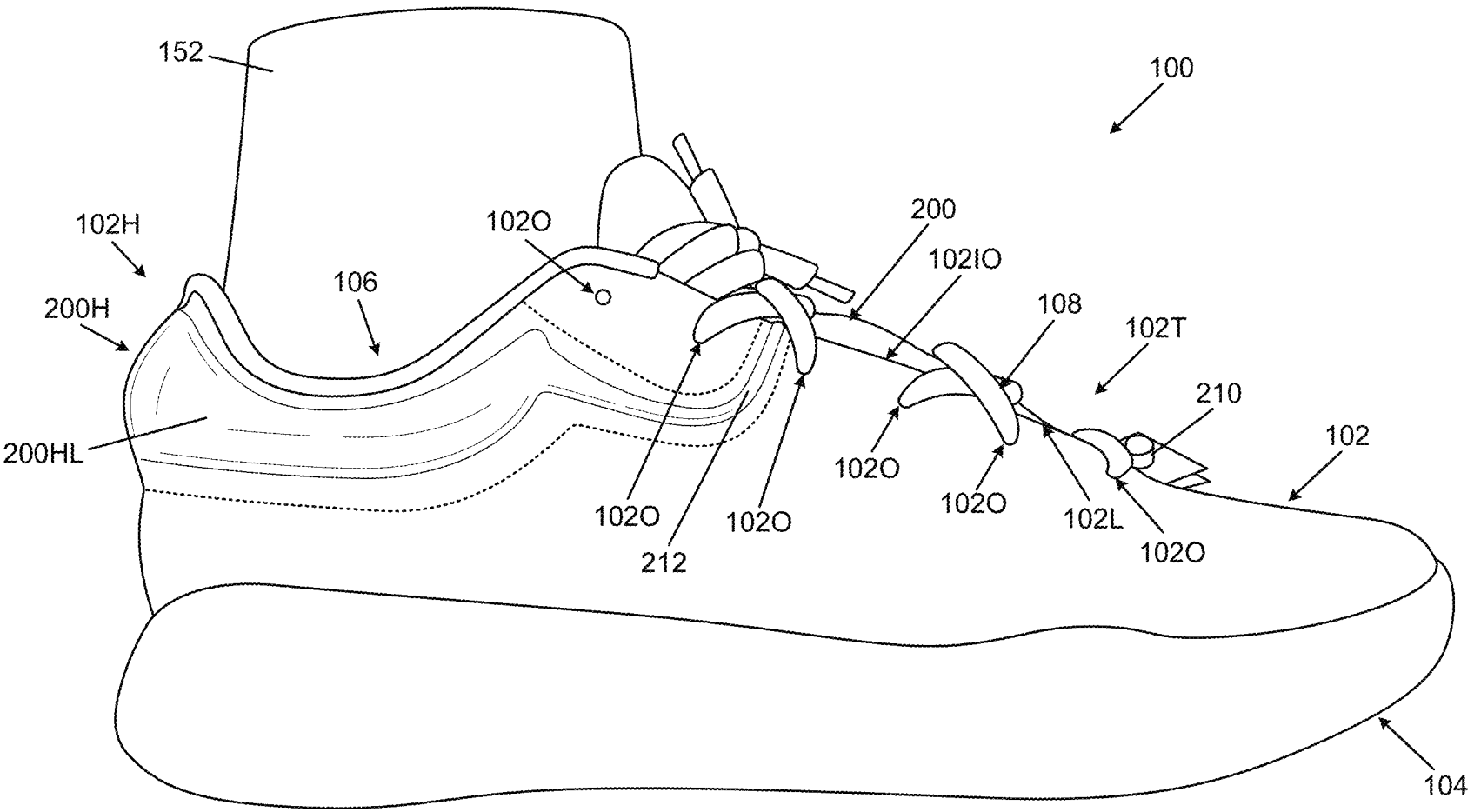
FIGS. 1A-1C provide various views of an article of footwear in accordance with some aspects of this technology.

In the following description of various examples of bladders, footwear uppers, and/or articles of footwear according to the present technology, reference is made to the accompanying drawings, which form a part hereof, and in which are shown by way of illustration various example structures and environments in which aspects of the technology may be practiced. It is to be understood that other structures and environments may be utilized and that structural and functional modifications may be made to the specifically described structures, functions, and methods without departing from the scope of the present disclosure.

I. General Description of Aspects of this Technology

As noted above, aspects of this technology relate to bladders, footwear uppers including such bladders, and articles of footwear including such bladders, e.g., of the types described and/or claimed below and/or of the types illustrated in the appended drawings. Such bladders, footwear uppers, and articles of footwear may include any one or more structures, parts, features, properties, and/or combination(s) of structures, parts, features, and/or properties of the examples described and/or claimed below and/or of the examples illustrated in the appended drawings.

This application and/or its claims use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "third" in the specification may correspond to any numerical adjective used for that component or feature in the claims).

This application describes footwear components (e.g., upper components (including fabric components), bladder components, sole structures, etc.) that may be "bonded" together. The term "bonded" (and derivatives thereof) means that the components are joined securely to one another. The term "bonded" encompasses bonds formed using adhesives or cements (including hot melt adhesives) as well as bonds formed in an "adhesive free" manner, i.e., without use of a separate adhesive component. "Adhesive free" bonds include bonds formed by fusing or melting components together (e.g., if the components include compositions that are compatible to mix and join together to form a bond, such as two components including a thermoplastic polyurethane component); bonds formed by welding techniques (e.g., RF welding, ultrasonic welding, high-frequency welding, laser welding, impulse welding, etc.); bonds formed by heat sealing; etc. Some adhesive free bonds may form a seamless joint between the two previously separate components (e.g., the materials mix and join together and then re-harden with no discernible junction). The term "melt bond" and variations thereof, as used herein, mean bonds formed where localized melting of each component occurs (e.g., melting of the thermoplastic polymer present in each component), the melted components combine together, and then the combined components harden to thereby "fuse" and "bond" the two components together. Such melt-bonded joints are adhesive free and may be seamless. The term "engaged with" is used herein as a generic term and includes both adhesive based bonds and adhesive free bonds within its scope as well as other potential types of engagement that fix (permanently or releasably) two (or more) components together in a "non-bonded" manner (including through the use of mechanical connectors or fasteners, through the use of sewing or stitching, etc.). The term "engage" (and variations thereof) also includes within its scope connecting two (or more) parts together in a releasable or relatively movable manner (such as a lace connected or otherwise interacting with one or more lace-engaging components in an article of footwear).

The term "strand" as used herein means an elongated component having a length at least 10 times greater than its width and/or thickness. A "strand" may include an elongated component formed from one or more fibers, one or more filaments, one or more threads, one or more yarns, one or more cables, one or more bands, one or more strings, one or more twines, one or more wires, one or more cords, one or more ropes, one or more fibers, or the like, optionally twisted, plaited, or laid parallel to form a unit. While "strands" may be flexible (e.g., to better wrap and/or conform to the shape of a wearer's foot), they may be substantially unstretchable (e.g., stretching less than 5% of their longitudinal length under a 10 kg tensile force).

The terms "lace" or "shoe lace" as used herein means an elongated component having a length at least 20 times greater than its width and/or thickness. "Laces" typically will have a cross sectional area transverse to its longitudinal length (i.e., longest) dimension of less than 2 $cm^2$. In at least some examples of this technology, a "lace" will have a width dimension, a thickness dimension, a cross sectional diagonal dimension, and/or a diameter dimension that is/are 12 mm or less over at least 75% of its longitudinal length dimension (which may be at least 300 mm long).

Some specific aspects or examples of this technology relate to footwear uppers that include:

(i) a footwear upper base formed from one or more component parts and including an instep region (e.g., defining an instep opening) that includes: (a) a first side edge having a plurality of first side lace-engaging openings defined therethrough and (b) a second side edge having a plurality of second side lace-engaging openings defined therethrough; and (ii) a bladder (e.g., extending across the instep opening from the first side edge to the second side edge), wherein the bladder includes: (a) a first tongue and/or instep chamber, (b) a first sealed seam region located at the first side edge, and (c) a second sealed seam region located at the second side edge, wherein the first tongue and/or instep chamber extends between the first sealed seam region and the second sealed seam region.

The first sealed seam region of this example structure includes a first lace-engaging opening. This first sealed seam region overlaps with the first side edge of the footwear upper base such that at least a portion of the first lace-engaging opening of the bladder's first sealed seam region aligns in an axial direction with at least a portion of a first opening of the plurality of first side lace-engaging openings of the footwear upper base.

Additionally or alternatively, some aspects of this technology relate to footwear uppers that include: (a) a footwear upper base formed from one or more component parts and including an instep region; (b) a first plurality of lace-engaging components (e.g., lace-engaging openings) located at a first side of the instep region; (c) a second plurality of lace-engaging components (e.g., lace-engaging openings) located at a second side of the instep region; (d) a bladder having at least a portion located at the instep region, wherein the bladder includes: (i) a first tongue and/or instep chamber, (ii) a first sealed seam region extending along a first side edge of the bladder, and (iii) a second sealed seam region extending along a second side edge of the bladder, wherein the first tongue and/or instep chamber extends between the first sealed seam region and the second sealed seam region; and (e) a lace extending through: (i) a first lace-engaging component of the first plurality of lace-engaging components and (ii) a first lace-engaging component of the second plurality of lace-engaging components, wherein the lace extends across and applies force to the first tongue and/or instep chamber.

Some examples of this technology include footwear uppers having: (a) a first lateral lace-engaging component; (b) a first medial lace-engaging component; (c) a bladder; and (d) a lace. The bladder may include: (i) at least one tongue and/or instep chamber having a first surface and an opposite second surface, (ii) a first heel and/or ankle support chamber, and (iii) a first fluid line placing the first heel and/or ankle support chamber in fluid communication with the tongue and/or instep chamber. In some examples, the bladder additionally may include a second heel and/or ankle support chamber, e.g., receiving fluid from a fluid line connected with the tongue and/or instep chamber and/or receiving fluid from a fluid line connected with the first heel and/or ankle support chamber. The lace engages the first lateral lace-engaging component and the first medial lace-engaging component, and the lace may extend across the first surface of the bladder one or more times, e.g., to apply force to the first surface of the bladder and move fluid from the tongue and/or instep chamber(s) to the heel and/or ankle support chamber(s) via the fluid line(s).

Additionally or alternatively, some aspects of this technology relate to footwear uppers that include: (a) a footwear upper base formed from one or more component parts; (b) a bladder including: (i) a first tongue and/or instep chamber located at an instep region of the footwear upper and having a first major surface located in the instep region, (ii) a heel and/or ankle support chamber, and (iii) a fluid line placing the first tongue and/or instep chamber in fluid communication with the heel and/or ankle support chamber; and (c) a lace extending across the first tongue and/or instep chamber of the bladder one or more times and applying force to the first major surface. This force can move fluid to the heel and/or ankle support chamber(s).

Additional or alternative aspects of this technology relate to bladders, e.g., of the types described above and/or those described in more detail below. In some more specific examples, the bladders may include: (a) a first thermoplastic sheet; (b) a second thermoplastic sheet facing the first thermoplastic sheet (formed from the same or different physical sheet of material as the first thermoplastic sheet); and (c) a continuous outer perimeter seam sealing the first thermoplastic sheet to the second thermoplastic sheet, wherein the continuous outer perimeter seam defines a sealed interior volume between the first thermoplastic sheet and the second thermoplastic sheet. This outer perimeter seam may extend to form the sealed interior volume to include a tongue and/or instep bladder chamber and/or a fluid supply chamber having a first major surface formed by the first thermoplastic sheet. In some examples, the outer perimeter seam further may extend to form (i) a first heel and/or ankle support chamber and (ii) a first fluid line connecting the tongue and/or instep bladder chamber and/or the fluid supply chamber with the first heel and/or ankle support chamber through the sealed interior volume. At least a first side edge portion of the outer perimeter seam may include one or more lace-engaging openings defined through it and/or other lace-engaging components associated with it (e.g., lace-engaging hardware components, such as hooks or rings, fixed to the outer perimeter seam).

Still additional or other alternative aspects of this technology relate to articles of footwear that include: (a) a footwear upper base; (b) a sole structure engaged with the footwear upper base, the footwear upper base and sole structure defining an interface where the footwear upper base meets the sole structure; (c) a first lateral lace-engaging component extending in a direction from the interface toward a lateral instep region of the footwear upper base (and, in some examples, partially wrapping around a wearer's foot); (d) a first medial lace-engaging component extending in a direction from the interface toward a medial instep region of the footwear upper base (and, in some examples, partially wrapping around a wearer's foot); (e) a bladder at least partially located between the first lateral lace-engaging component and the first medial lace-engaging component, the bladder including at least one tongue and/or instep chamber having a first surface and an opposite second surface; and (f) a lace engaging the first lateral lace-engaging component and the first medial lace-engaging component, wherein a first portion of the lace extends across the first surface. The first lateral lace-engaging component and/or the first medial lace-engaging component may originate at or extend from the interface (e.g., within 25 mm of the interface) and/or may extend between surfaces of the footwear upper base and the sole structure. The bladder further may include: (i) at least one heel and/or ankle support chamber (e.g., a lateral heel and/or ankle support chamber and/or a medial heel and/or ankle support chamber), and (ii) at least one fluid line placing the heel and/or ankle support chamber(s) in fluid communication with the tongue and/or instep chamber (e.g., a first fluid line directly connecting a tongue and/or instep chamber with one heel and/or ankle support chamber, a second fluid line connecting a tongue and/or instep chamber with another heel and/or ankle support chamber, a second fluid line connecting one heel and/or ankle support chamber with another heel and/or ankle support chamber, etc.).

Further aspects of this technology relate to articles of footwear including bladders and/or footwear uppers of the various types described above. Still additional aspects of this technology relate to methods of making the bladders, footwear uppers, and/or articles of footwear described above and in more detail below and/or methods of using the bladders, footwear uppers, and/or articles of footwear described above and in more detail below.

Given the general description of features, examples, aspects, structures, and methods according to examples of the technology provided above, more detailed descriptions of specific example footwear uppers, bladders, articles of footwear, and methods in accordance with this technology follow.

Figure 1B:
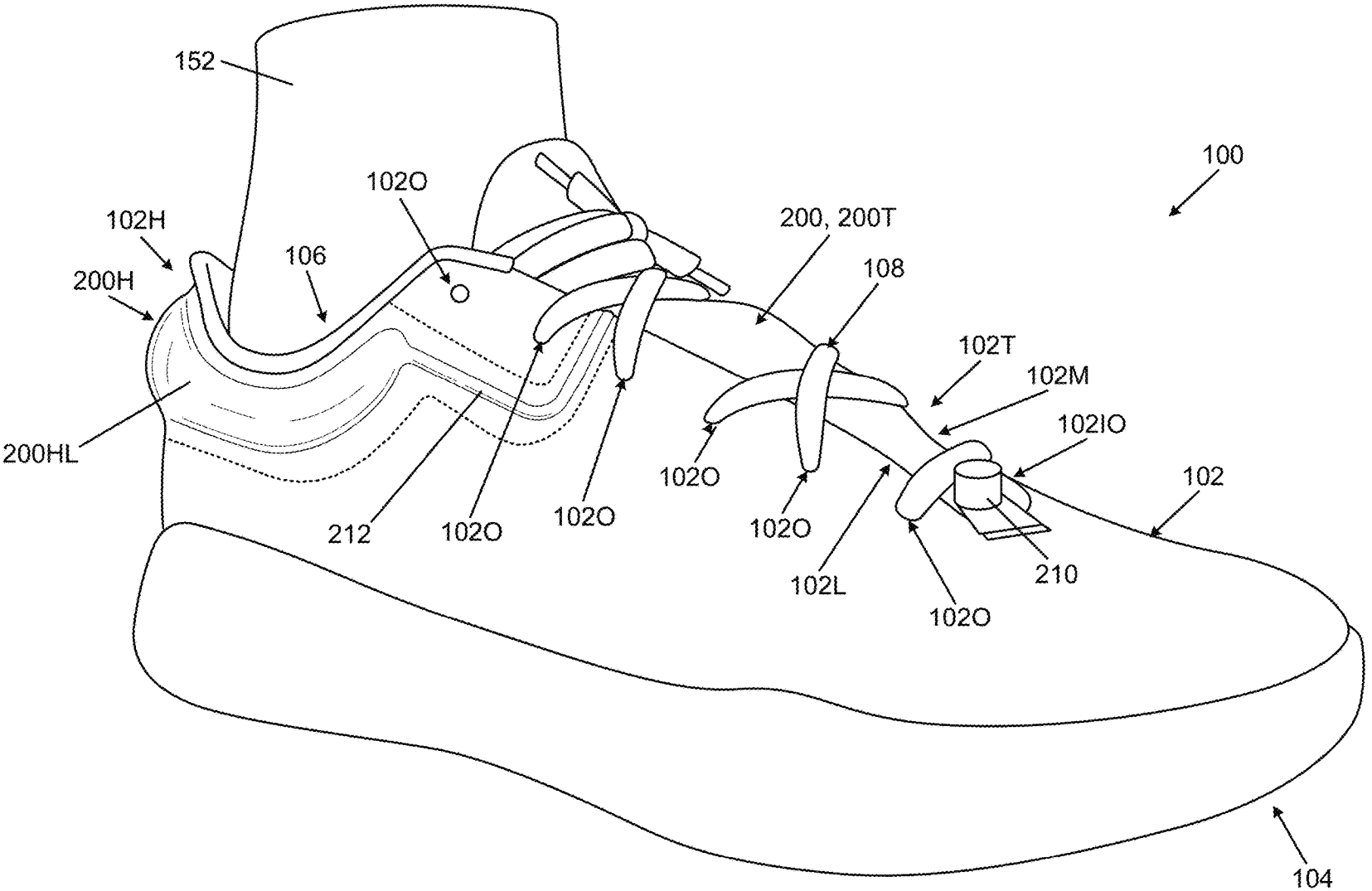
Figure 1C:
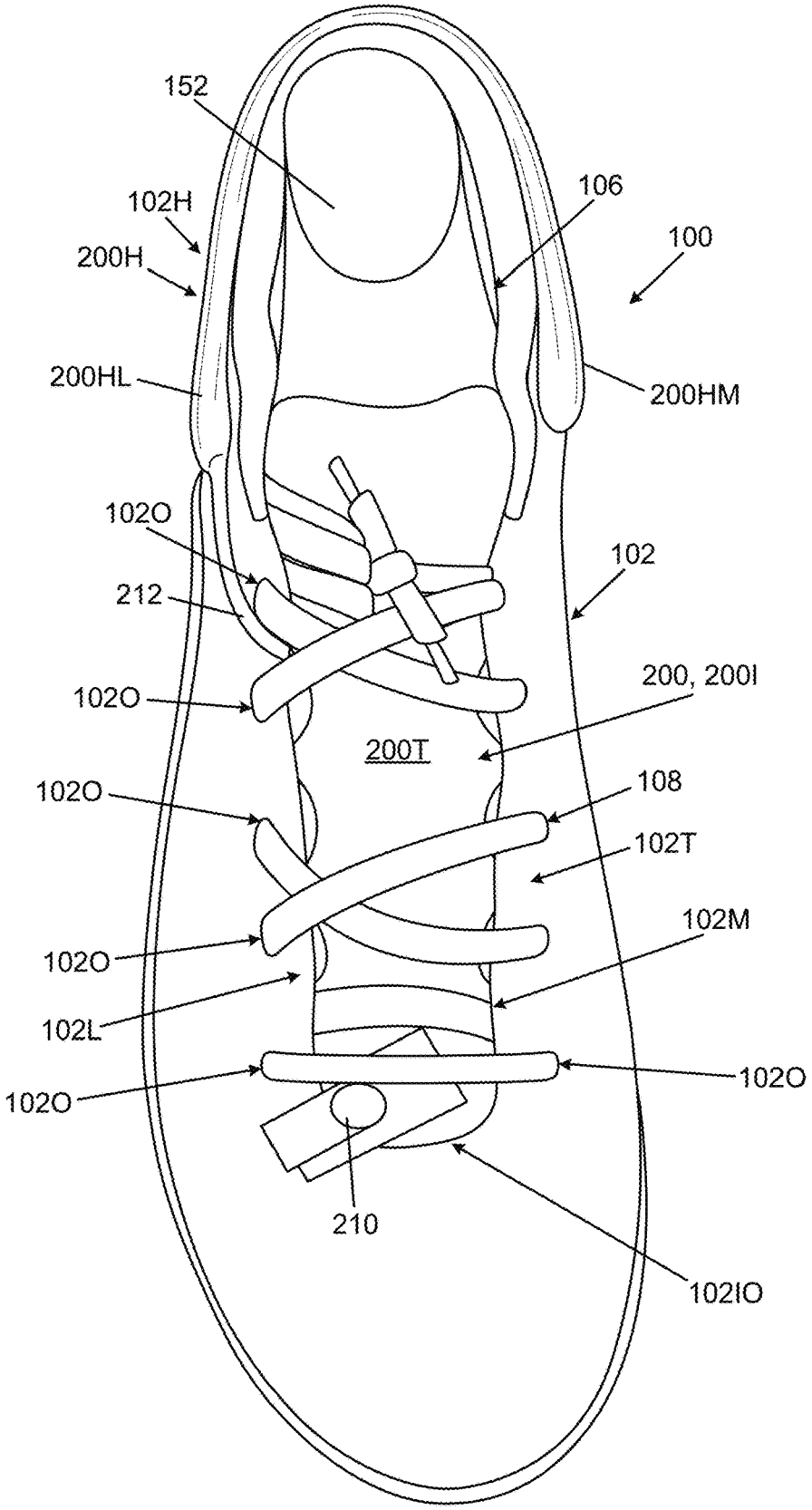

II. Detailed Description of Example Bladders, Footwear Uppers, Articles of Footwear, Heel and/or Ankle Support Systems, and Other Components and/or Features According to this Technology FIGS. 1A-1C illustrate various views of an article of footwear 100 in accordance with some examples of this technology. FIG. 1A provides a lateral side view, FIG. 1B provides a lateral, front perspective view, and FIG. 1C provides a top view of the article of footwear 100. The article of footwear 100 includes a footwear upper base 102 formed from one or more component parts. The term "footwear upper base" as used herein means a footwear upper, optionally made from one or more conventional parts and/or made in conventional manners. Other components, such as a bladder system and a footwear securing system (e.g., a lace system) may be engaged with or otherwise associated with the footwear upper base 102. The footwear upper base 102 may be formed from one or more component parts, e.g., one or more fabric components (e.g., one or more knit components) and/or one or more other components. When multiple parts are present, the component parts of the footwear upper base 102 may be engaged together in any desired manner, including by sewn seams, by melt bonds, by welding techniques, by adhesives, by mechanical connectors, etc., including through use of conventional engagement techniques known and used in the footwear arts.

In this illustrated example, the footwear upper base 102 includes: (i) an instep region 102T having at least one of a tongue base region or an instep base region and (ii) a heel-containing region 102H. The footwear upper base 102 further defines a foot-receiving opening 106. A sole structure 104, including one or more component parts, engages the footwear upper base 102. The sole structure 104 may have any desired construction and/or component parts and/or may be engaged with the footwear upper base 102 in any desired manner, including conventional constructions and/or component parts and/or assembled using conventional engagement methods as are known and used in the footwear arts.

FIGS. 1A-1C further illustrate that this example footwear upper base 102 includes an instep opening 102IO defined at the instep region 102T. This example instep opening 102IO includes a first side edge 102L (e.g., a lateral side edge in this example) having a plurality of first side lace-engaging components 102O (which in this illustrated example comprise lace-engaging openings defined through the footwear upper base 102). This instep opening 102IO further includes a second side edge 102M (e.g., a medial side edge in this example) having a plurality of second side lace-engaging components (which in this illustrated example also comprise lace-engaging openings 102O defined through the footwear upper base 102). One or more other types of lace-engaging components could be provided with the footwear upper base 102 along with and/or in place of lace-engaging openings 102O, such as hook components, loop components, flexible strands, etc. FIGS. 1A-1C show a lace 108 engaged with at least some of the lace-engaging components 102O. In the lacing pattern shown in FIG. 1C, the lace 108 crosses itself twice as it passes above and contacts the exterior major surface of the bladder 200. In between the locations where the lace 108 is visible in FIG. 1C, the lace 108 may cross itself and pass beneath the interior major surface of the bladder 200 in the tongue and/or instep region 200T or it may extend between adjacent lace-engaging openings 102O on the first side edge 102L or the second side edge 102M. Other lacing patterns and/or arrangements of the lace 108 with respect to the lace-engaging components 102O (and/or lace-engaging openings 202O described below) are possible without departing from this technology.

The footwear 100 structure of FIGS. 1A-1C further includes a bladder 200 (e.g., a fluid-filled bladder filled with a gas, such as air or other gas) located at the instep region 102T (e.g., extending across the instep opening 102IO). Bladder 200 may be formed from thermoplastic materials (e.g., one or more sheets of thermoplastic material, such as thermoplastic polyurethane (or "TPU") materials) as are known and used in the footwear art. In this illustrated example, as best shown in FIGS. 1B and 1C, the bladder 200 includes at least a portion extending from the first side edge 102L to the second side edge 102M of the instep opening 102IO. Although other structures are possible, in this example structure, the bladder 200 includes a sealed interior fluid-filled chamber 200I forming a tongue and/or instep chamber that may take the place of a conventional footwear tongue. In such structures, the bladder 200's fluid-filled chamber 200I may help moderate the feel of the lace 108 on the instep region of a wearer's foot.

Figure 2A:
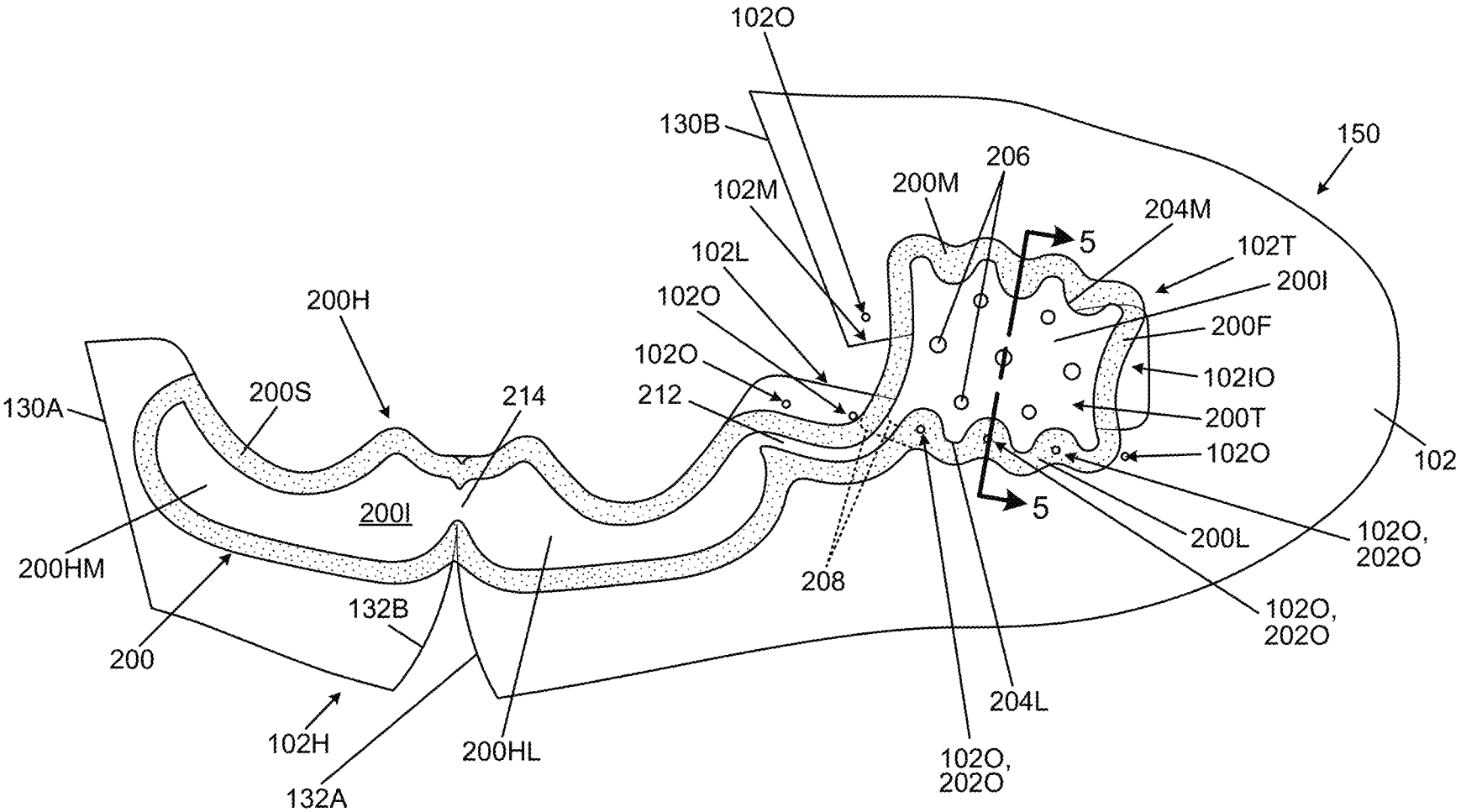
FIG. 2A provides a view of an upper blank including a bladder in accordance with some examples of this technology.
Figure 2B:
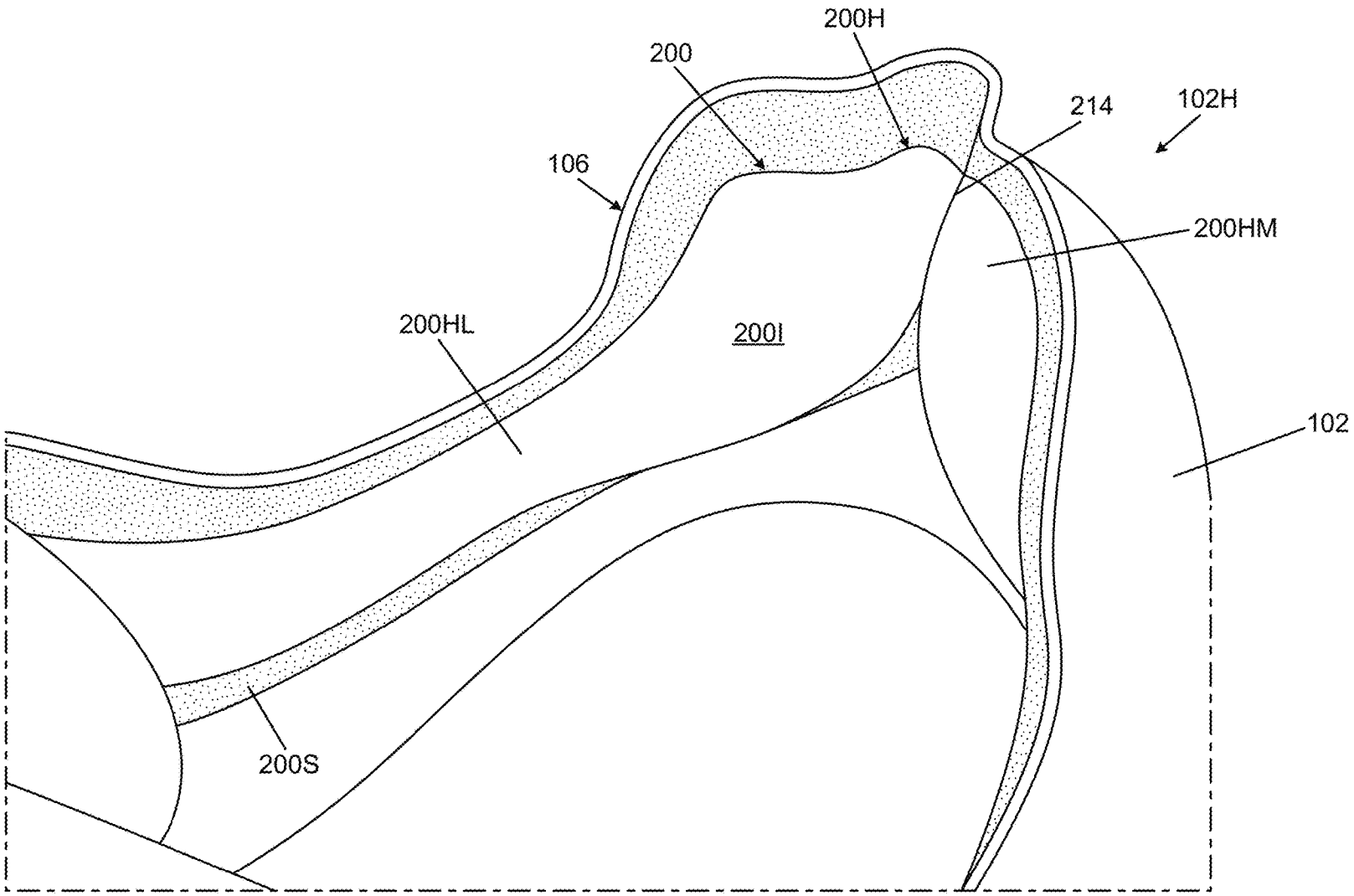
FIG. 2B provides an interior view of a portion of a bladder engaged with a footwear upper base in accordance with some examples of this technology.

Turning to FIGS. 2A and 2B together with FIGS. 1A-1C, this example bladder 200 will be described in more detail. FIG. 2A shows an interior view of an upper blank 150 (a footwear upper before it is engaged with a sole structure 104) including a footwear upper base 102 and a bladder 200 engaged with it. FIG. 2B shows the rear heel area of the completed footwear upper base 102 (looking inside the foot-receiving opening 106). The bladder 200 may be engaged with one or more components of the footwear upper base 102 in any desired manner, including using stitching or sewing (through the outer perimeter seam 200S of the bladder 200), using adhesives or cements, using welding, melt-bonding or fuse-bonding techniques, etc. In some examples of this technology, at least some portion(s) of the bladder 200 will be engaged with one or more footwear upper base 102 components (including a knit footwear upper base 102 component) at least in part in an adhesive-free manner and/or in any of the manners described in U.S. Patent Appln. No. 63,277,916, filed Nov. 10, 2021 and/or U.S. Patent Appln. No. 63,277,932, filed Nov. 10, 2021 each entitled "Footwear Uppers Including Bladders and Articles of Footwear Including Bladders in the Upper" and each of which is entirely incorporated herein by reference.

The bladder 200 of this example includes: (i) a tongue and/or instep chamber 200T (filled with fluid, such as a gas), (ii) a first sealed seam region 200L located at the first side edge 102L of the footwear upper base 102, and (iii) a second sealed seam region 200M located at the second side edge 102M of the footwear upper base 102. As shown in FIG. 2A, the tongue and/or instep chamber 200T extends between the first sealed seam region 200L and the second sealed seam region 200M of the bladder 200. The first sealed seam region 200L and the second sealed seam region 200M form portions of an outer perimeter seam 200S of the bladder 200. The outer perimeter seam 200S of this example further includes a forward seam region 200F joining the first sealed seam region 200L and the second sealed seam region 200M at a forward-most location of the bladder 200 in the footwear upper and/or article of footwear 100.

As further shown in FIG. 2A, the first sealed seam region 200L in this example includes a first lace-engaging opening 202O (along with other lace-engaging openings 202O). In use when secured to a wearer's foot, the first sealed seam region 200L overlaps with the first side edge 102L of the footwear upper base 102 such that at least a portion of the first lace-engaging opening 202O aligns in an axial direction with at least a portion of a lace-engaging component 102O (e.g., a lace-engaging opening) of the plurality of lace-engaging components (e.g., openings) provided along the first side edge 102L of the footwear upper base 102. The example of FIG. 2A shows three lace-engaging openings 202O through the first sealed seam region 200L that at least partially align in the axial direction with corresponding three lace-engaging components 102O (e.g., lace-engaging openings) provided along the first side edge 102L of the footwear upper base 102. Any one or more of the lace-engaging openings 202O could be replaced by another type of lace-engaging component, such as a loop component, a hook component, a hardware component, etc.

If desired, in at least some examples of this technology, at least a portion of the first sealed seam region 200L may be fixedly engaged with the footwear upper base 102, e.g., along the first side edge 102L, e.g., such that one or more of the lace-engaging openings 202O is/are fixed with respect to the respective lace-engaging component 102O (e.g., opening) provided with the footwear upper base 102. Such a fixed arrangement may help keep the various parts in place in the tongue area, e.g., for ease of use. Additionally, in this illustrated example, the opposite side of the tongue and/or instep chamber 200T including the second sealed seam region 200M remains unfixed to the footwear upper base 102. This unfixed arrangement can ease the process of inserting and removing the foot and securing the footwear upper base 102 to a wearer's foot. If desired, even if not permanently fixed together, the second sealed seam region 200M may include one or more lace-engaging openings (e.g., like 202O) that align with lace-engaging components 102O on the second side edge 102M of the footwear upper base 102 so that the second sealed seam region 200M can be releasably engaged with the footwear upper base 102 along second side edge 102M by lace 108. See FIG. 3.

During manufacture, the footwear upper blank 150 may be secured to a last 152 (see FIGS. 1A-1C), e.g., in conventional manners as are used in the footwear arts. Once secured to a last 152, the sole structure 104 (e.g., formed separately) may be engaged with the footwear upper blank 150. The bladder 200 may be inflated (via inflation port 210) before or after it is engaged with the footwear upper base 102 and/or before or after it is engaged with the sole structure 104. After inflation to a desired pressure, the inflation port 210 may be permanently sealed and trimmed off. In some examples of this technology, the bladder 200 will be permanently sealed so that the bladder 200 contains a fixed mass of gas throughout its lifetime (i.e., the bladder forms a "closed" system). Alternatively, if desired, an inflation port and/or deflation port could be provided in the bladder 200, e.g., to enable a user to change bladder 200 gas mass (by inserting gas or expelling gas) and to enable a user to change and control pressure in the bladder 200.

FIG. 2A further shows that the tongue and/or instep chamber 200T includes a first chamber side edge 204L that extends along and is defined by the first sealed seam region 200L. The first sealed seam region 200L of this example includes a continuous seam (part of outer perimeter seam 200S) that is shaped to form the first chamber side edge 204L as a wave shape. The wave shape of the first chamber side edge 204L includes plural wave peaks. One or more of the lace-engaging openings 202O of the first sealed seam region 200L and the lace-engaging components 102O (e.g., lace-engaging openings) of the first side edge 102L of the instep opening 102IO are located between adjacent wave crests of the wave peaks in this example structure. Similarly, the second sealed seam region 200M also may include a continuous seam (part of outer perimeter seam 200S) that is shaped to form the second chamber side edge 204M as a wave shape. While FIG. 2A shows smoothly curved waves and troughs on each side edge 204L and 204M, other shapes and/or arrangements for the side edges 204L and/or 204M of tongue and/or instep chamber 200T are possible. For example, a square or rectangular waveform could be used. As another example, no wave structure is needed (e.g., the chamber side edges 204L and/or 204M and/or the seam regions 200L and/or 200M could be straight or curved without forming a wave pattern).

FIG. 2A further shows that this example tongue and/or instep chamber 200T includes interior connections 206 in the form of spaced apart connection spots. These interior connections 206 control the three-dimensional shape of the tongue and/or instep chamber 200T when inflated. These interior connections 206 may be formed by engaging the interior surfaces of the thermoplastic sheets forming the bladder chamber 200I to one another. This may be accomplished, for example, by welded connections, by melt-bonded or fuse-bonded connections, by adhesive connections, by interior components engaged with each interior surface, etc. Any desired arrangement and/or pattern of one or more interior connections 206 may be used with this technology to create the desired bladder 200 shape.

In some examples of this technology, the tongue and/or instep chamber 200T portion of the bladder 200 may form the entire fluid-filled bladder 200. In FIG. 2A, broken lines 208 show potential locations where the bladder 200 could end (the broken lines 208 outlining where outer perimeter seam 200S could be located) to provide only a tongue and/or instep chamber 200T. In such structures, the tongue and/or instep chamber 200T may be used to moderate the feel of the lace 108 on a wearer's foot. In the illustrated example, at least a portion of the tongue and/or instep chamber 200T is exposed between the first side edge 102L and the second side edge 102M of the footwear upper base 102 instep region 102T. If desired, however, the tongue and/or instep chamber 200T may be at least partially covered on one or both sides (or even completely covered on one side or both sides), e.g., with a fabric or textile material.

The bladder 200 structure of FIG. 2A, however, further includes a heel and/or ankle support chamber 200H in fluid communication with the tongue and/or instep chamber 200T by at least one fluid line 212. In the illustrated example, the heel and/or ankle support chamber 200H includes a lateral heel and/or ankle support chamber 200HL and a medial heel and/or ankle support chamber 200HM. A fluid line 214 or other opening and/or connection at the rear heel area of the footwear upper base 102 places the lateral heel and/or ankle support chamber 200HL in fluid communication with the medial heel and/or ankle support chamber 200HM in this illustrated example. Additionally or alternatively, in at least some examples of bladders 200, an axial length of the fluid line 214 from the first heel and/or ankle support chamber 200HL to the second heel and/or ankle support chamber 200HM will be less than 35 mm, and in some examples, less than 30 mm, less than 25 mm, less than 20 mm, or even less than 15 mm. The fluid line 214 may have a minimum length of at least 4 mm in the example ranges provided above.

As further shown in FIG. 2A, in this example bladder 200 structure, a single continuous perimeter seam 200S defines the first tongue and/or instep chamber 200T, the heel and/or ankle support chamber 200H (including both the lateral heel and/or ankle support chamber 200HL and the medial heel and/or ankle support chamber 200HM), and the fluid lines 212, 214. The first sealed seam region 200L and the second sealed seam region 200M form portions of the single continuous perimeter seam 200S. Also, in this example, the fluid line 212 is located on a lateral side of the footwear upper base 102. In fact, the fluid line 212 extends between adjacent lace-engaging components 102O (e.g., lace-engaging openings) of the plurality of lace-engaging components 102O located at the first side edge 102L of the footwear upper base 102. In this illustrated structure, the entire volume inside the outer perimeter seam 200S forms an interior fluid chamber 200I in open fluid communication. Thus, force applied to an exterior surface of the tongue and/or instep chamber 200T by the lace 108 (e.g., when tightening the lace 108 and securing the footwear 100 to a wearer's foot) and/or by bending of the instep area of a wearer's foot (e.g., during a step or jump) moves fluid from the tongue and/or instep chamber 200T to the heel and/or ankle support chamber 200H via fluid line 212. This movement of fluid increases fluid volume and/or fluid pressure in the heel and/or ankle support chamber 200H. This action provides additional heel and/or ankle support and/or improves comfort and/or fit in the heel area (by eliminating excess space in the shoe interior).

As shown in FIGS. 1A-1C and 2B, in this illustrated example, at least a portion of the heel and/or ankle support chamber 200H is located inside (e.g., covered at an exterior surface of the footwear 100) at least one of the component parts of the footwear upper base 102. Similarly, at least a portion of the fluid line 212 and/or fluid line 214 is/are located inside (e.g., covered at an exterior surface of the footwear 100) at least one of the component parts of the footwear upper base 102. In fact, in the examples of FIGS. 1A-2B, the entire heel and/or ankle support chamber 200H, the entire fluid line 212, and the entire fluid line 214 are located inside the outermost surface of the footwear upper base 102. If desired, these components of bladder 200 may be visible and exposed at an interior surface of the footwear upper base 102, e.g., as shown in FIGS. 2A and 2B. Additionally or alternatively, the heel and/or ankle support chamber 200H, the fluid line 212, and/or the fluid line 214 may be covered or at least partially covered in the interior of the footwear upper base 102 (e.g., by a fabric component).

FIGS. 1A-2B show the fluid line 212 extending along a lateral side of the article of footwear 100 directly to the lateral heel and/or ankle support chamber 200HL. The lateral heel and/or ankle support chamber 200HL supplies fluid to the medial heel and/or ankle support chamber 200HM via fluid line 214. Alternatively, if desired, the structure could be changed so that fluid line 212 extends along a medial side of the article of footwear 100 directly to the medial heel and/or ankle support chamber 200HM (and from there the fluid can flow to the lateral heel and/or ankle support chamber 200HL via fluid line 214). As a more specific example, in the depiction shown in FIG. 2A, the bottom of the figure could constitute the medial side of the upper blank 150 and the top of the figure could constitute the lateral side of the upper blank 150.

Figure 3:
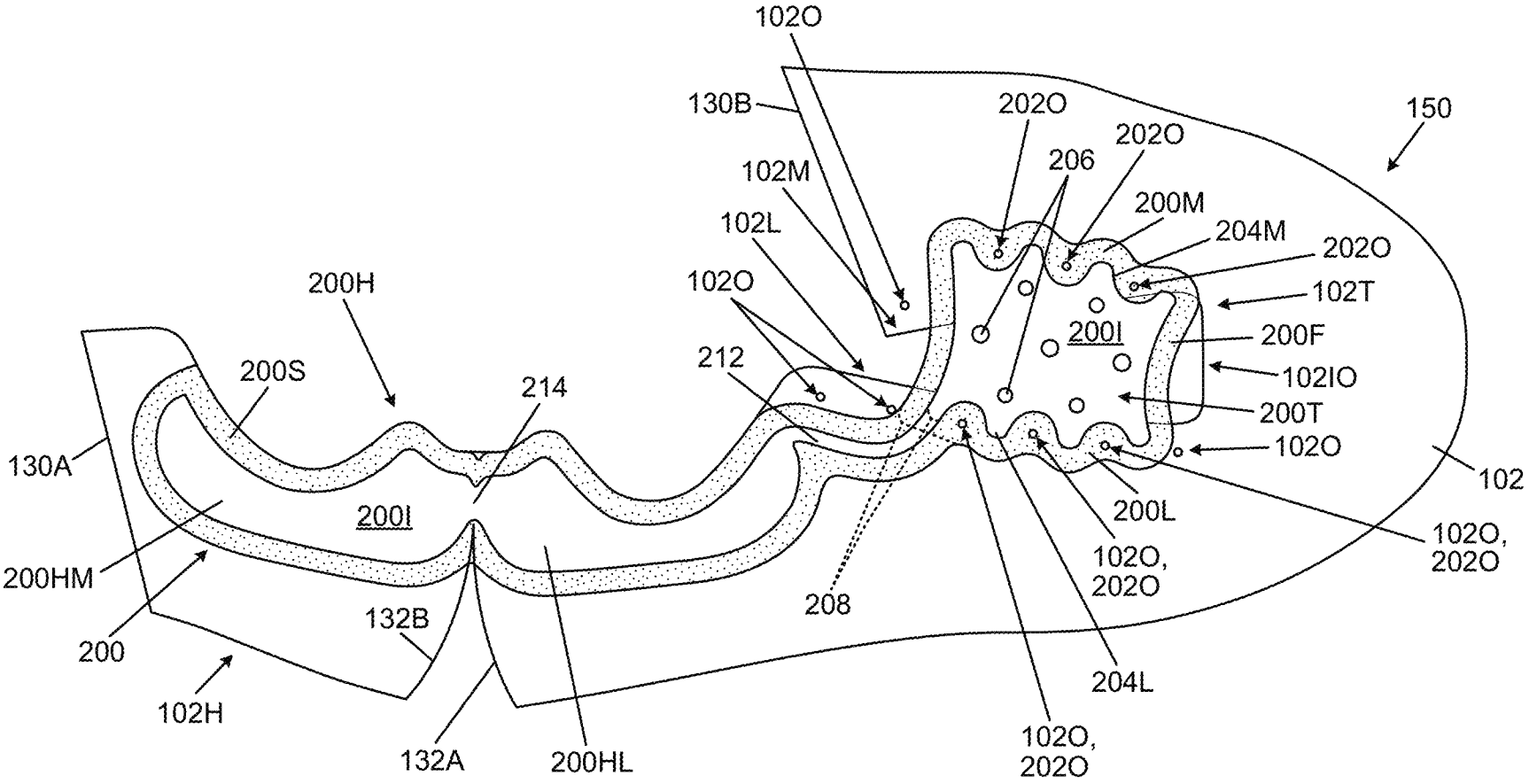
FIGS. 3 and 4 provide views of upper blanks including bladders in accordance with additional examples of this technology.

FIG. 3 illustrates another example footwear upper base 102, upper blank 150, and bladder 200 structure in accordance with some aspects of this technology. Where the same reference numbers are used in FIG. 3 as used in FIGS. 1A-2B, the same or similar parts are being referred to and much of the corresponding description may be omitted. The following disclosure focuses primarily on differences between the footwear upper base 102, upper blank 150, and bladder 200 structure of FIG. 3 as compared with the footwear upper base 102, upper blank 150, and bladder 200 structures of FIGS. 1A-2B. All of the above options, alternatives, additional features, etc., described above for the parts shown in FIGS. 1A-2B also may be provided for the same or similar parts shown in FIG. 3.

One difference between bladder 200 of FIG. 3 and those described above in conjunction with FIGS. 1A-2B relates to the presence of one or more lace-engaging openings 202O (or other lace-engaging components) at the second sealed seam region (the medial sealed seam region 200M in the example of FIG. 3). In use (e.g., when an article of footwear 100 is secured to a wearer's foot), the second sealed seam region 200M overlaps with the second side edge 102M of the footwear upper base 102 such that at least a portion of the lace-engaging openings 202O in the second sealed region 200M align in an axial direction with at least a portion of corresponding lace-engaging components 102O (e.g., lace-engaging openings) provided along the second side edge 102M. As will be described more in conjunction with FIGS. 5A-5C, a lace 108 can extend through the axially aligned portions of lace-engaging openings 202O and lace-engaging components 102O to releasably secure the medial side of the bladder 200 (the second sealed seam region 200M) with the medial side edge 102M of the footwear upper base 102. The lace 108 also can extend across the surface of the bladder 200's tongue and/or instep chamber 200T one or more times and through axially aligned portions of lace-engaging openings 202O and lace-engaging components 102O at the lateral side of the bladder 200 (e.g., engaging (optionally releasably engaging) the first sealed seam region 200L with the lateral side edge 102L of the footwear upper base 102). Note FIG. 1C.

Like the example of FIG. 2A, in the example bladder 200 structure of FIG. 3, the entire volume inside the outer perimeter seam 200S forms an interior fluid chamber 200I in open fluid communication. Thus, force applied to a surface of the tongue and/or instep chamber 200T by the lace 108 (e.g., when tightening the lace 108 and securing the footwear 100 to a wearer's foot) and/or by bending of the instep area of a wearer's foot (e.g., during a step or jump) moves fluid from the tongue and/or instep chamber 200T to the heel and/or ankle support chamber 200H via fluid line 212. This movement of fluid increases fluid volume and/or fluid pressure in the heel and/or ankle support chamber 200H. This action provides additional heel and/or ankle support and/or improves comfort and/or fit in the heel area (by eliminating excess space in the shoe interior).

In some examples of this technology (including the examples of FIGS. 1A-3, as well as the example of FIG. 6 discussed below), the bladder 200's interior volume 200I defined by the perimeter seam 200S will consist of (or consist essentially of): (i) a tongue and/or instep chamber 200T, (ii) a first fluid line 212, (iii) a first heel and/or ankle support chamber 200HL, (iv) a second fluid line or opening 214, and (v) a second heel and/or ankle support chamber 200HM. As some more specific examples, the perimeter seam 200S will enclose interior volume 200I and at least 80% of the total enclosed interior volume 200I (and in some examples, at least 85%, at least 90%, at least 95%, or even 100% of the total enclosed interior volume 200I) will be located in components (i) through (v) above. The interior volume 200I may be in open fluid communication throughout. The chamber(s) 200T, 200HL, and/or 200HM may include two or more interconnected fluid-containing pods or bulbs.

Figure 4:
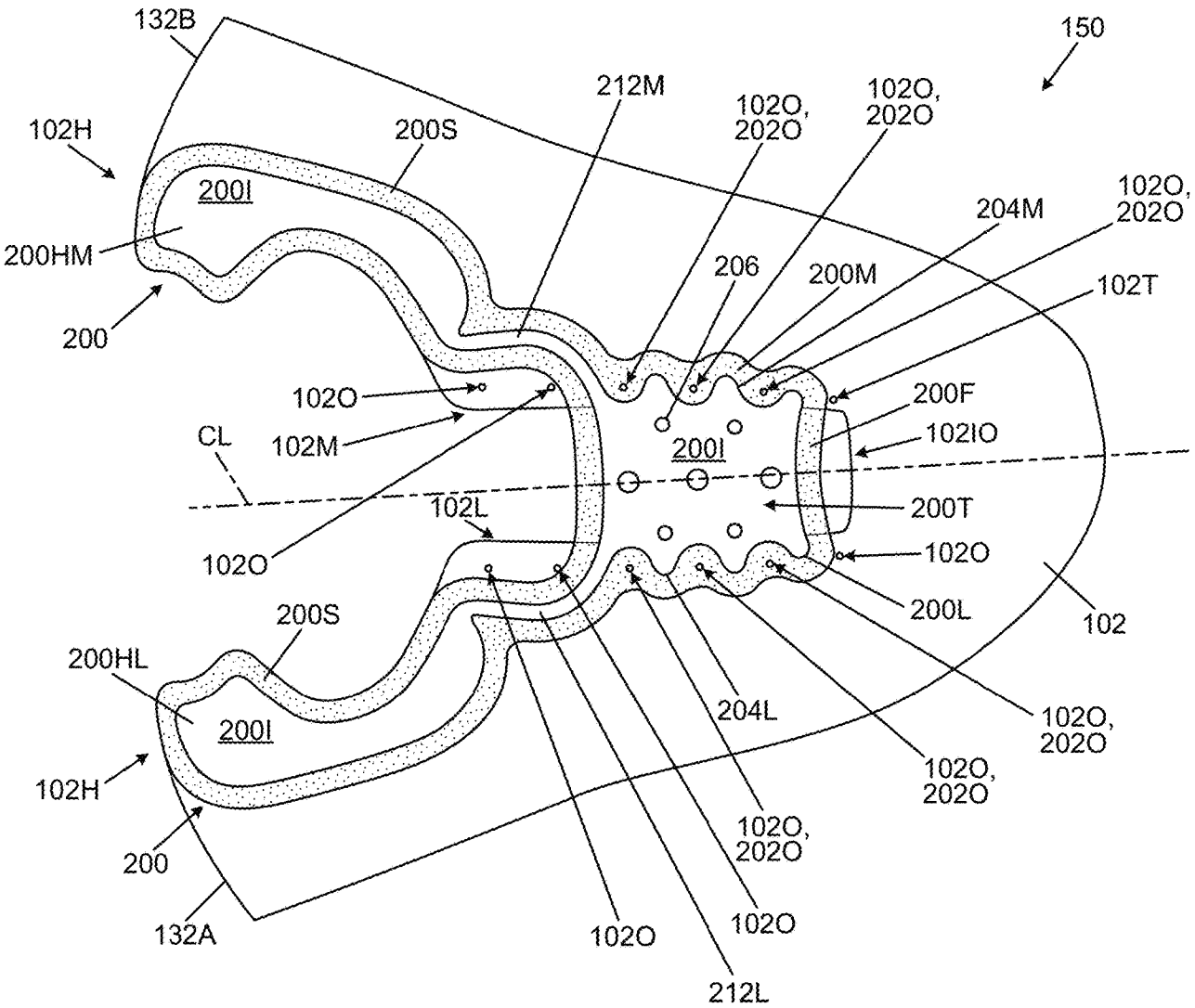

FIG. 4 illustrates another example footwear upper base 102, upper blank 150, and bladder 200 structure in accordance with some aspects of this technology. Where the same reference numbers are used in FIG. 4 as used in FIGS. 1A-3, the same or similar parts are being referred to and much of the corresponding description may be omitted. The following disclosure focuses primarily on differences between the footwear upper base 102, upper blank 150, and bladder 200 structure of FIG. 4 as compared with the footwear upper bases 102, upper blanks 150, and bladders 200 of FIGS. 1A-3. All of the above options, alternatives, additional features, etc., described above for the parts shown in FIGS. 1A-3 also may be provided for the same or similar parts shown in FIG. 4.

The footwear upper bases 102, upper blanks 150, and bladders 200 shown in FIGS. 2A and 3 have asymmetrical structures in which one side of each of these parts includes a portion that wraps around and forms a rear heel area of the component. Thus, the seam joining the two free ends of the upper blanks 150 together join free edges 130A and 130B and is located at one side of the footwear upper (e.g., the medial midfoot or heel side in the illustrated example). Also, the heel and/or ankle support chambers 200H of the examples of FIGS. 2A and 3 wrap around the rear heel areas of the upper blanks 150 and include lateral heel and/or ankle support chambers 200HL and medial heel and/or ankle support chambers 200HM joined by fluid lines or openings 214 located at the rear heel area.

In contrast, the footwear upper base 102, upper blank 150, and bladder 200 structure of FIG. 4 have more symmetrical structures (more symmetric down a front-to-back center line CL). For example, the heel-containing region 102H of the upper blank 150 of FIG. 4 is divided into two halves that can be joined at a rear heel seam between edges 132A and 132B. Similarly, the bladder structure 200 of FIG. 4 includes lateral heel and/or ankle support chamber 200HL separated from medial heel and/or ankle support chamber 200HM (e.g., no fluid line or opening 214 exists to move fluid directly between the lateral heel and/or ankle support chamber 200HL and the medial heel and/or ankle support chamber 200HM). Rather, lateral heel and/or ankle support chamber 200HL is in fluid communication with the tongue and/or instep fluid chamber 200T via fluid line 212L and medial heel and/or ankle support chamber 200HM is in fluid communication with the tongue and/or instep fluid chamber 200T via fluid line 212M, which extends along a medial side of the footwear upper base 102. Fluid line 212L may have any of the features (e.g., locational features) of fluid line 212 described above. Fluid line 212M extends from the tongue and/or instep chamber 200T between two adjacent lace-engaging components 102O (e.g., openings) provided at the medial side edge 102M of the instep opening 102IO.

In the example bladder 200 structure of FIG. 4, the entire volume inside the outer perimeter seam 200S forms an interior fluid chamber 200I in open fluid communication. In this example, force applied to an exterior surface of the tongue and/or instep chamber 200T by the lace 108 (e.g., when tightening the lace 108 and securing the footwear 100 to a wearer's foot) and/or by bending of the instep area of a wearer's foot (e.g., during a step or jump) moves fluid from the tongue and/or instep chamber 200T to: (a) the lateral heel and/or ankle support chamber 200HL via fluid line 212L and (b) the medial heel and/or ankle support chamber 200HM via fluid line 212M. This movement of fluid increases fluid volume and/or fluid pressure in both the lateral heel and/or ankle support chamber 200HL and the medial heel and/or ankle support chamber 200HM to provide additional heel and/or ankle support and/or to improve comfort and/or fit in the heel area (by eliminating excess space in the shoe interior).

In some examples of this technology (including the example of FIG. 4, as well as the example of FIGS. 8A-8F discussed below), the bladder 200's interior volume 200I defined by the perimeter seam 200S will consist of (or consist essentially of): (i) a tongue and/or instep chamber 200T, (ii) a first fluid line 212L, (iii) a first heel and/or ankle support chamber 200HL, (iv) a second fluid line 212M, and (v) a second heel and/or ankle support chamber 200HM. As some more specific examples, the perimeter seam 200S will enclose interior volume 200I and at least 80% of the total enclosed interior volume 200I (and in some examples, at least 85%, at least 90%, at least 95%, or even 100% of the total enclosed interior volume 200I) will be located in components (i) through (v) above. The interior volume 200I may be in open fluid communication throughout. The chamber(s) 200T, 200HL, and/or 200HM may include two or more interconnected fluid-containing pods or bulbs.

Figure 5A:
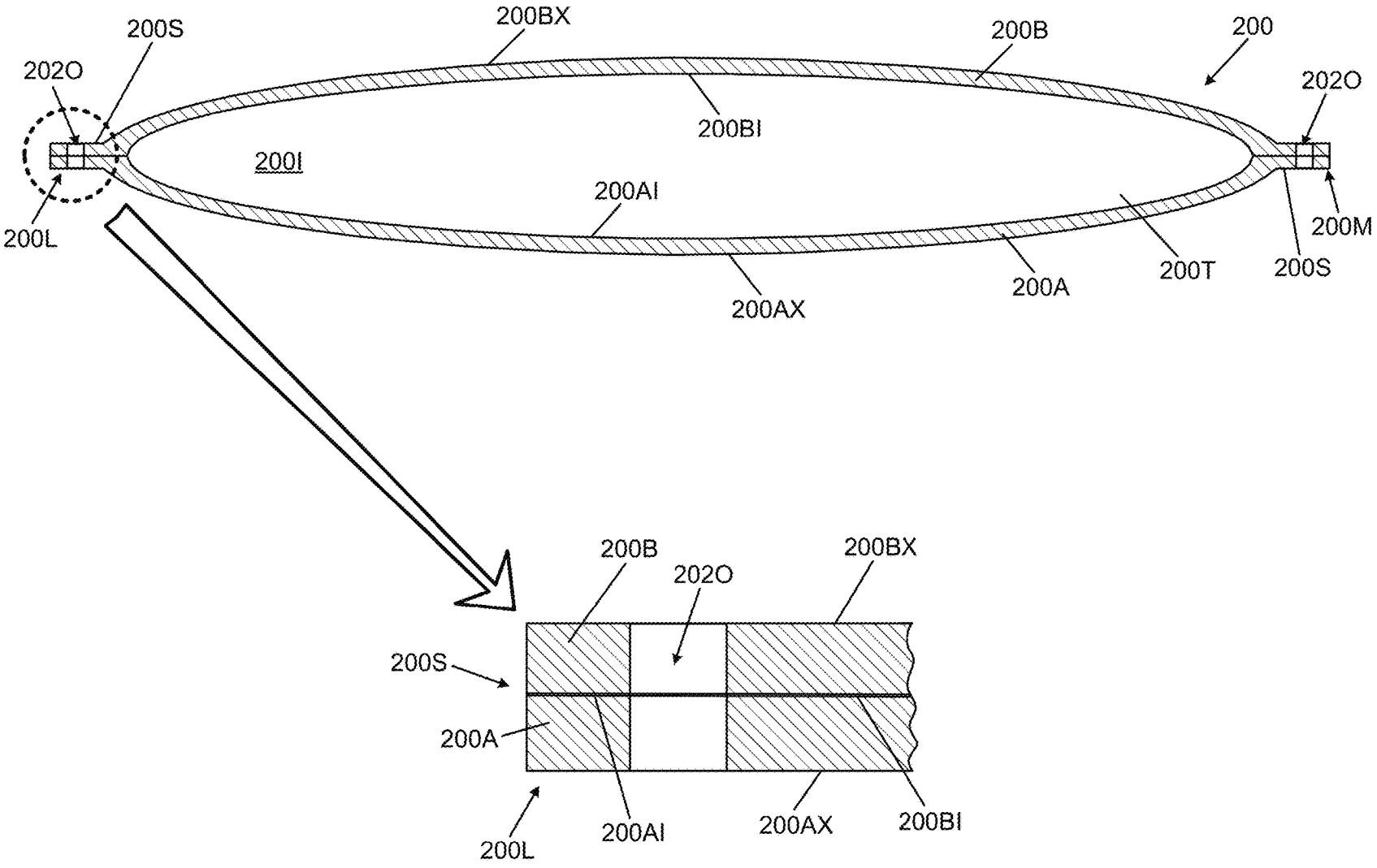
FIGS. 5A-5C provide various views of a bladder, its seam, and its engagement with a lace in accordance with some examples of this technology.

FIG. 5A illustrates a cross-sectional view of a bladder 200 (e.g., like bladder 200 at line 5-5 shown in FIG. 2A). Bladders 200 of this type may be formed from a first thermoplastic sheet 200A and a second thermoplastic sheet 200B facing the first thermoplastic sheet 200A. Each sheet includes an interior surface and an exterior surface, e.g., with sheet 200A including interior surface 200AI and exterior surface 200AX and sheet 200B including interior surface 200BI and exterior surface 200BX. First thermoplastic sheet 200A and second thermoplastic sheet 200B may be separate sheets or may be separate portions of a single sheet (e.g., a larger sheet that is folded on one edge to produce two interior surfaces 200AI and 200BI facing one another).

An outer perimeter seam 200S sealingly engages the first thermoplastic sheet 200A to the second thermoplastic sheet 200B by bonding interior surface 200AI to interior surface 200BI. Any suitable manner of sealingly joining sheets 200A and 200B together may be used, including welding techniques (e.g., ultrasonic welding, RF welding, etc.), other bonding techniques (e.g., melt bonding, fusing, etc.), adhesive bonding, adhesive free bonding, etc. The outer perimeter seam 200S defines a sealed interior volume 200I between interior surfaces 200AI and 200BI of the first thermoplastic sheet 200A and the second thermoplastic sheet 200B, respectively. As described above in conjunction with FIGS. 1A-4, the outer perimeter seam 200S may extend continuously to form the sealed interior volume 200I to include at least one fluid supply chamber (e.g., at least one tongue and/or instep chamber 200T) having major surfaces formed by the first thermoplastic sheet 200A and the second thermoplastic sheet 200B. Additionally, in at least some examples of this technology, the outer perimeter seam 200S further may extend to form: (i) at least one heel and/or ankle support chamber (e.g., heel and/or ankle support chamber 200H, lateral heel and/or ankle support chamber 200HL, and/or medial heel and/or ankle support chamber 200HM), and (ii) at least one fluid line (e.g., fluid line 212, fluid line 214, fluid line 212L, and/or fluid line 212M) connecting the fluid supply chamber(s) (e.g., tongue and/or instep chamber (s) 200T) with the heel and/or ankle support chamber(s). Further, as shown in FIG. 5A, at least one side edge portion of the outer perimeter seam 200S (e.g., at least one of lateral sealed seam region 200L and/or medial sealed seam region 200M) includes a lace-engaging opening 202O defined through it (or other type of lace-engaging component engaged with it (e.g., a loop member, a hook member, other hardware, etc.)). In the example shown in FIG. 5A, a hole is formed through the first thermoplastic sheet 200A and the second thermoplastic sheet 200B in the sealed region of the seam 200S where interior surface 200AI is sealed and joined to interior surface 200BI.

Figure 5B:
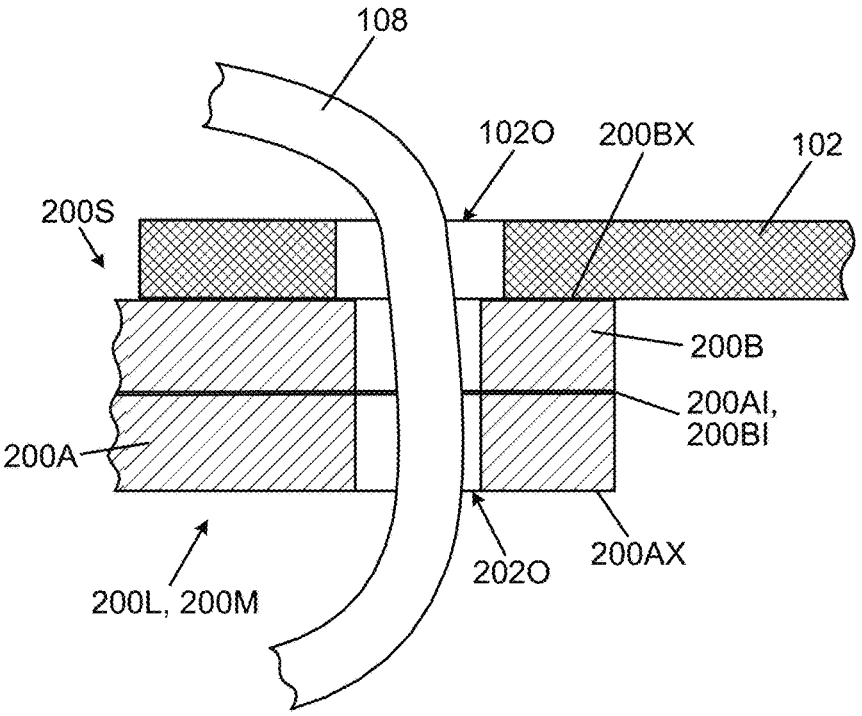
Figure 5C:
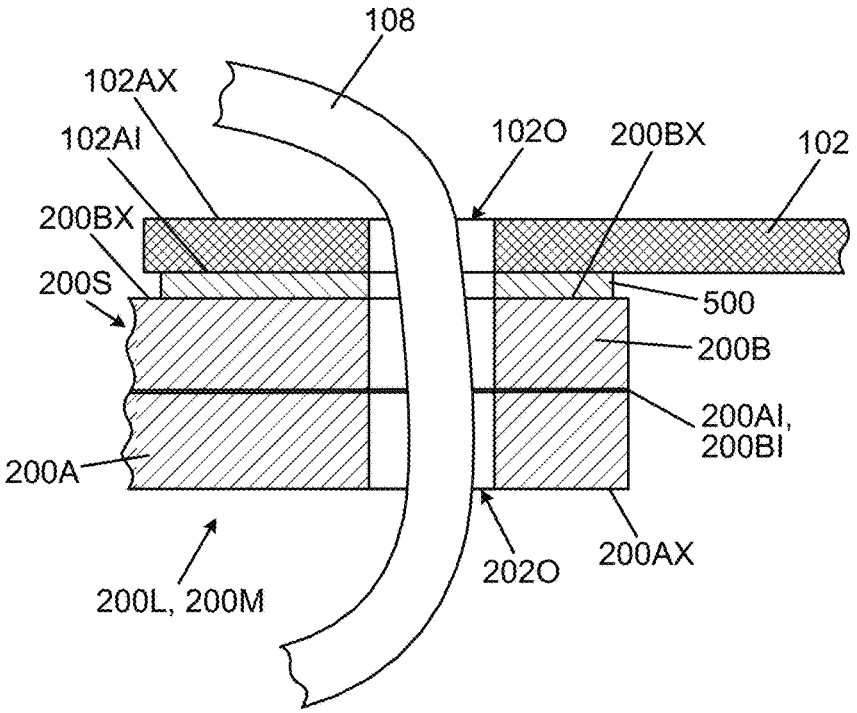

FIGS. 5B and 5C provide partial cross-sectional views similar to the enlarged seam portion shown in FIG. 5A, but FIGS. 5B and 5C further include a component of the footwear upper base 102 (e.g., a fabric component) and the lace 108. As shown, the lace 108 extends through the lace-engaging opening 202O of the bladder 200 and engages (e.g., extends through) the lace-engaging component 102O of the footwear upper base 102. In some examples of this technology, at least some portion of the outer perimeter seam 200S (e.g., at the first sealed seam region 200L and/or the second sealed seam region 200M) may be fixedly engaged with the footwear upper base 102 component, e.g., adhesively bonded, adhesively free bonded, sewn, etc.). Such fixed engagement may help keep the lace-engaging openings/components 102O/202O at least partially axially aligned, e.g., as shown in FIGS. 5B and 5C. Alternatively, if desired, one or both of the first sealed seam region 200L and/or the second sealed seam region 200M may remain unfixed or not permanently fixed to the footwear upper base 102 component. Once the lace 108 is engaged with the lace-engaging openings/components 102O/202O, this lace 108 can sufficiently hold bladder 200 edges and the footwear upper base 102 components together to permit insertion of the wearer's foot and securing the shoe 100 to the wearer's foot.

The structure of FIG. 5C is similar to that shown in FIG. 5B, but the structure of FIG. 5C further includes a reinforcing element 500. Reinforcing element 500 may constitute a metal ring (e.g., a crimped metal ring, a metal ring or washer structure, etc.), a plastic ring or washer structure, a tear resistant fabric layer, or other structure. Reinforcing element 500 inhibits tearing of the thermoplastic sheets 200A, 200B and/or the footwear upper base 102 when the lace 108 is pulled tight. One or more reinforcing elements 500 could be located anywhere in the bladder 200 perimeter seam 200S structure. While the illustrated example shows reinforcing element 500 located between interior surface 102AI of the footwear upper base 102 and the exterior surface 200BX of the second thermoplastic sheet 200B in the sealed seam region 200L/200M, other arrangements are possible. For example, additionally or alternatively, one or more reinforcing elements 500 may be engaged with one or more of: the exterior surface 102AX of the footwear upper base 102, between the interior surfaces 200AI and 200BI of the thermoplastic sheets 200A, 200B, and/or with the exterior surface 200AX of the first thermoplastic sheet 200A.

Figure 6:
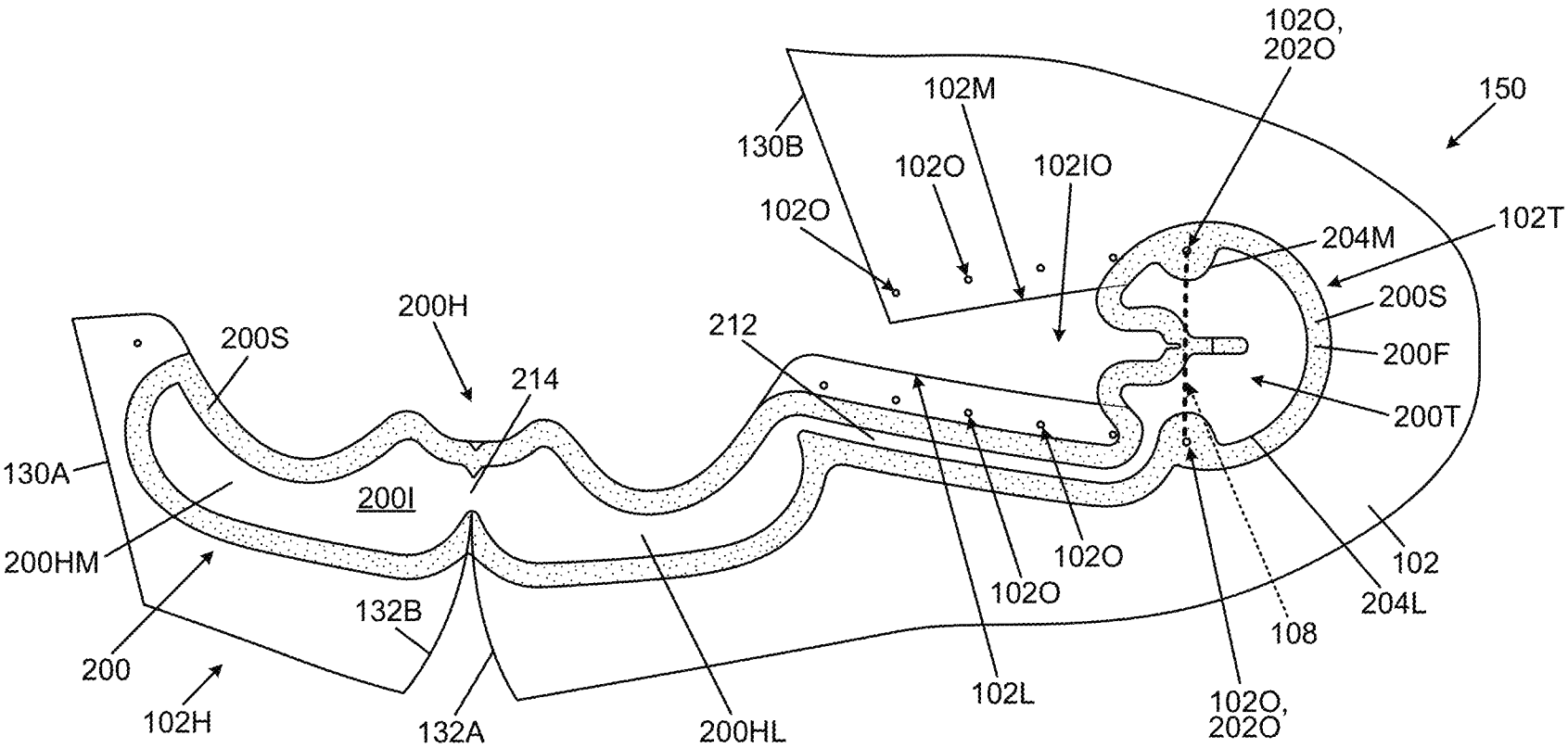
FIG. 6 provides a view of another upper blank including a bladder in accordance with some examples of this technology.

FIG. 6 illustrates another example footwear upper base 102, upper blank 150, and bladder 200 structure in accordance with some aspects of this technology. Where the same reference numbers are used in FIG. 6 as in FIGS. 1A-5C, the same or similar parts are being referred to and much of the corresponding description may be omitted. The following disclosure focuses primarily on differences between the footwear upper base 102, upper blank 150, and bladder 200 structure of FIG. 6 as compared with the footwear upper bases 102, upper blanks 150, and bladders 200 of FIGS. 1A-5C. All of the above options, alternatives, additional features, etc., described above for the parts shown in FIGS. 1A-5C also may be provided for the same or similar parts shown in FIG. 6.

In the illustrated example of FIG. 6, the tongue and/or instep chamber 200T is located further forward on the footwear upper base 102 as compared to the locations shown in the examples of FIGS. 1A-5C. For this reason, the first fluid line 212 is lengthened in the front-to-back direction of the footwear upper base 102 (as compared to the other illustrated examples) and extends along and close to the lateral side edge 102L of the instep opening region 102IO. More specifically, first fluid line 212 extends along a row of lace-engaging components 102O provided along the lateral side edge 102L of the instep region 102T. In this illustrated example, the outer perimeter seam 200S defining the first fluid line 212 does not overlap at least some of the lace-engaging components 102O. Alternatively, if desired, outer perimeter seam 200S could overlap one or more of the lace-engaging components 102O (e.g., openings) along fluid line 212, and lace-engaging openings 202O may be provided to at least partially axially align with the lace-engaging component(s) 102O located beneath the seam 200S.

Also, in this illustrated example, the forward-most lace-engaging component 102O on each of the lateral side edge 102L and the medial side edge 102M of the instep opening region 102IO is configured to align with corresponding lace-engaging openings 202O (or other lace-engaging components) provided with the bladder 200. The tongue and/or instep bladder chamber 200T includes a seam (e.g., part of outer perimeter seam 200S), and the lace-engaging openings 202O (or other lace-engaging components) are provided at that seam 200S. A lace 108 (shown by a broken line in FIG. 6) may extend across the tongue and/or instep bladder chamber 200T and engage lace-engaging components/openings 102O/202O. In this manner, application of force to a surface of the tongue and/or instep bladder chamber 200T moves fluid from the tongue and/or instep bladder chamber 200T to the heel and/or ankle support chamber 200H via fluid line 212. Additionally or alternatively, force applied to a surface of the tongue and/or instep chamber 200T by bending of the instep area of a wearer's foot (e.g., as the wearer moves during a step or jump) may move fluid from the tongue and/or instep chamber 200T to the heel and/or ankle support chamber 200H via fluid line 212. Instep bending may be used to move fluid in the manner described above (in all of the example structures of FIGS. 1A-6) whether or not the lace 108 is present and/or whether or not the lace 108 is sufficiently tightened to apply force to the fluid supply chamber (i.e., to the tongue and/or instep bladder chamber 200T).

Figure 7A:
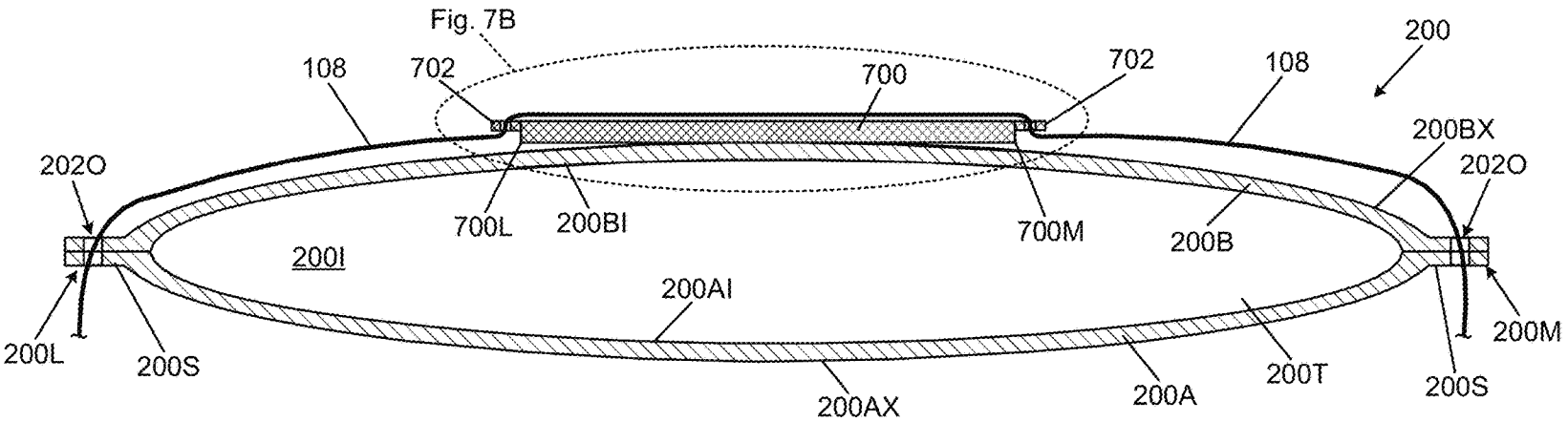
FIGS. 7A-7C provide various views of a portion of a footwear product according to some examples of this technology that include one or more rigid plates between the bladder surface and lace.

FIGS. 1A-6 illustrate example articles of footwear 100, footwear upper bases 102, upper blanks 150, and bladders 200 in which a lace 108 engages a surface of the bladder 200 (optionally through a layer of fabric) to apply force to the tongue and/or instep bladder chamber 200T. Other options are possible. For example, FIG. 7A includes a view of a bladder 200 cross section similar to FIG. 5A in which a rigid plate 700 is provided between the surface 200BX of the bladder 200 and the lace 108. FIG. 7B provides a partial top view of this bladder 200/plate 700 combination. In this illustrated example, the rigid plate 700 includes one or more lace-engaging components 702, e.g., at each side edge 700L, 700M of rigid plate 700. Although other options are possible, the lace-engaging components 702 of this example include a hole 702H (see FIG. 7B) through which the lace 108 extends. The rigid plate 700 (e.g., made from metal, rigid plastic, stiff fabric, etc.) increases the surface area applying force (from the lace 108) to the bladder 200, e.g., to increase fluid volume moved to the fluid line 212 (or fluid lines 212L, 212M) and/or to the heel and/or ankle support chamber(s) 200H. Additionally or alternatively, the rigid plate 700 also may further help moderate the feel of the lace 108 against the instep area of a wearer's foot.

Figure 7C:
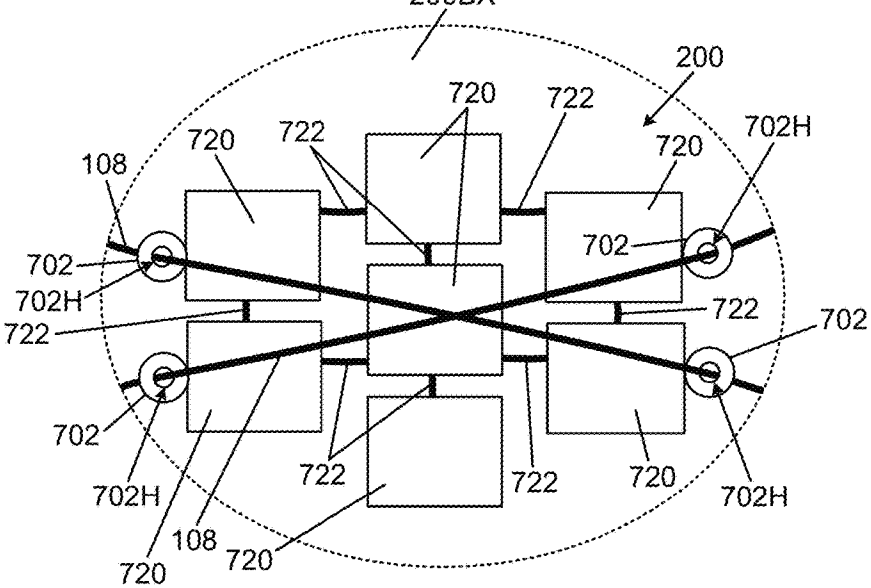
Figure 7B:
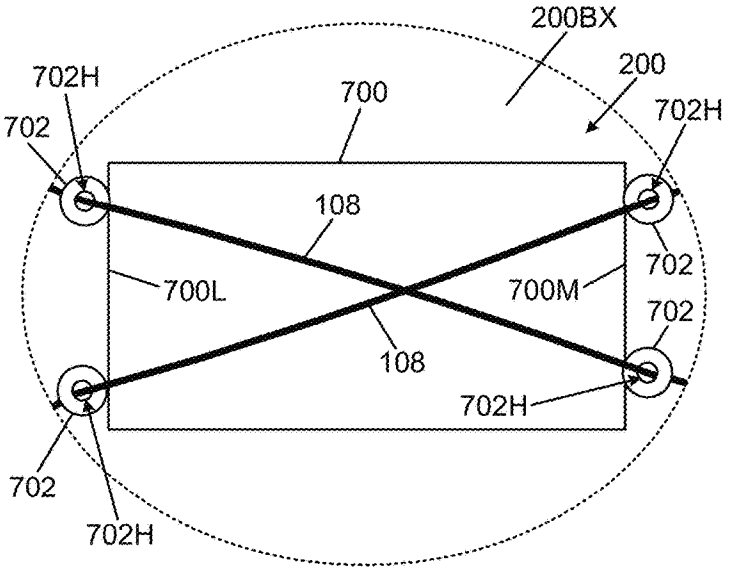

FIG. 7C provides a view similar to FIG. 7B, but the single rigid plate 700 of FIG. 7B is replaced by multiple, smaller rigid plates 720. The smaller rigid plates 720 in this example are connected to at least one neighboring smaller rigid plate 720, e.g., by one or more flexible connectors 722 (e.g., made of plastic, fabric, etc.). Any desired number of smaller rigid plates 720 (e.g., from 2 to 30 smaller rigid plates 720) in any desired arrangement (e.g., in a matrix structure, in rows and columns, in staggered rows, in staggered columns, in a random arrangement, in a patterned arrangement, etc.) may be provided without departing from this technology. At least some of the smaller rigid plates 720 in this illustrated example of FIG. 7C include a lace-engaging component 702, e.g., a hole 702H through which the lace 108 extends.

A rigid plate system with multiple rigid plates 720, e.g., like the system shown in FIG. 7C), increases the surface area applying force (from the lace 108) to the bladder 200, e.g., to increase fluid volume moved to the fluid line 212 (or fluid lines 212L, 212M) and/or to the heel and/or ankle support chamber(s) 200H. Additionally or alternatively, such rigid plate systems with multiple rigid plates 720 may help moderate the feel of the lace 108 against the instep area of a wearer's foot. Still additionally or alternatively, rigid plate systems with multiple rigid plates 720, e.g., of the type shown in FIG. 7C, can better conform to and follow the contours of the bladder 200's surface 200BX and/or a wearer's foot, e.g., as the lace 108 is tightened.

FIGS. 8A-8F provide various views of other example articles of footwear 800 in accordance with some examples of this technology. Where the same reference numbers are used in FIGS. 8A-8F as used in the other figures, the same or similar parts are being referenced, and some or all of the corresponding description may be omitted. Those same or similar parts may have any of the properties, features, options, alternative, additional features, etc., for the corresponding parts described above.

Figure 8A:
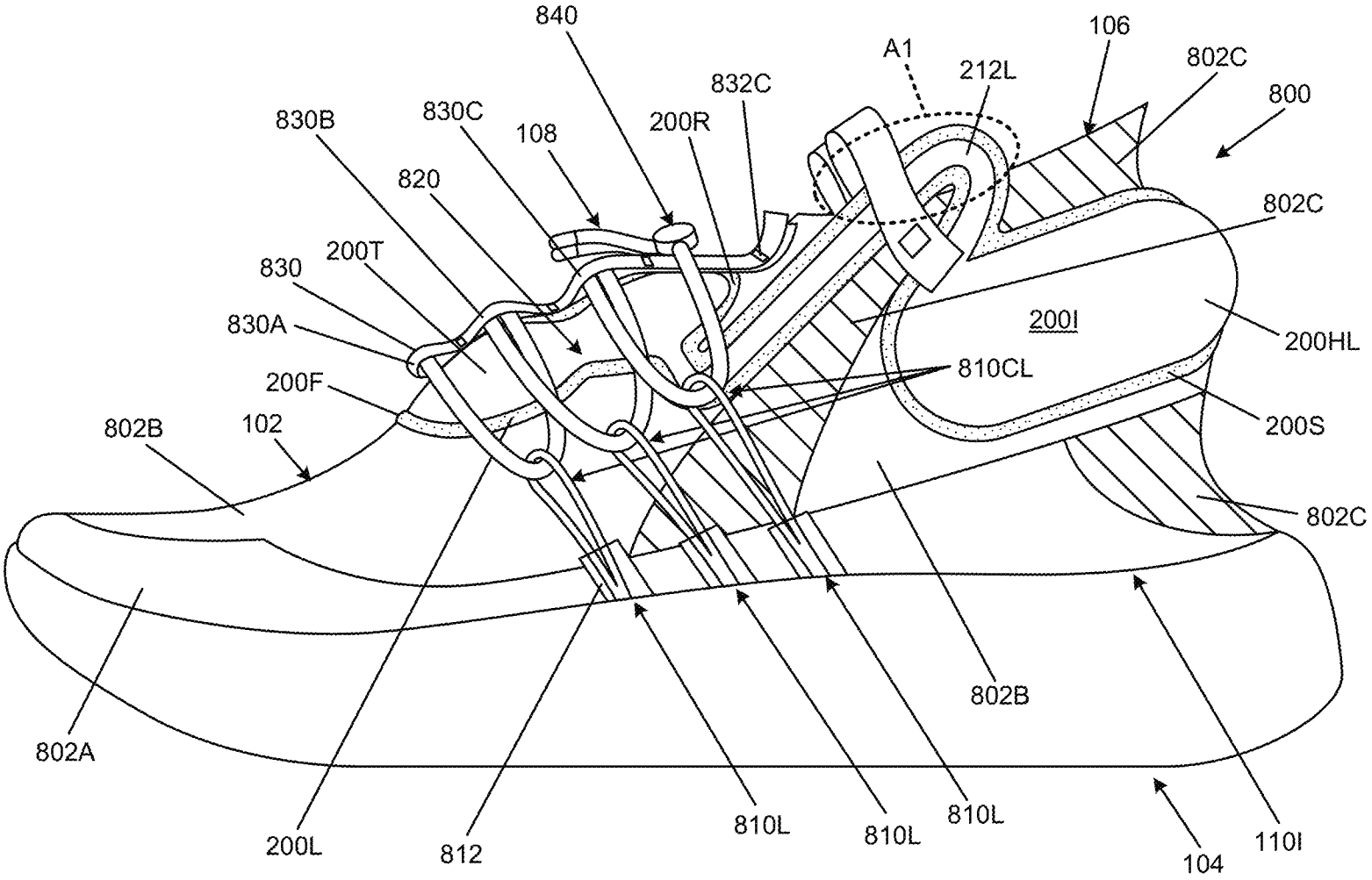
FIGS. 8A-8F provide various views of another example footwear product and components thereof according to at least some examples of this technology.
Figure 8B:
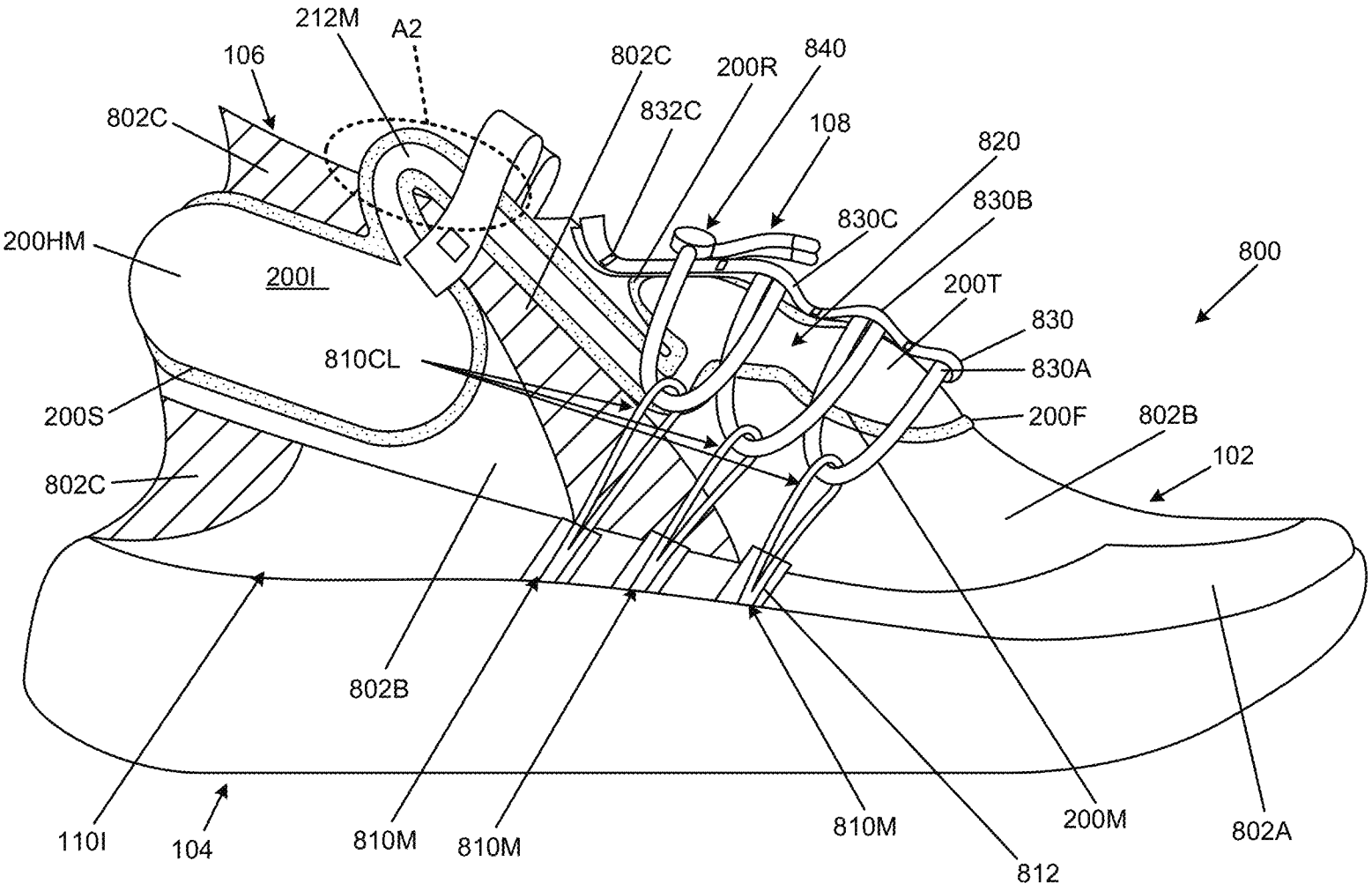
Figure 8C:
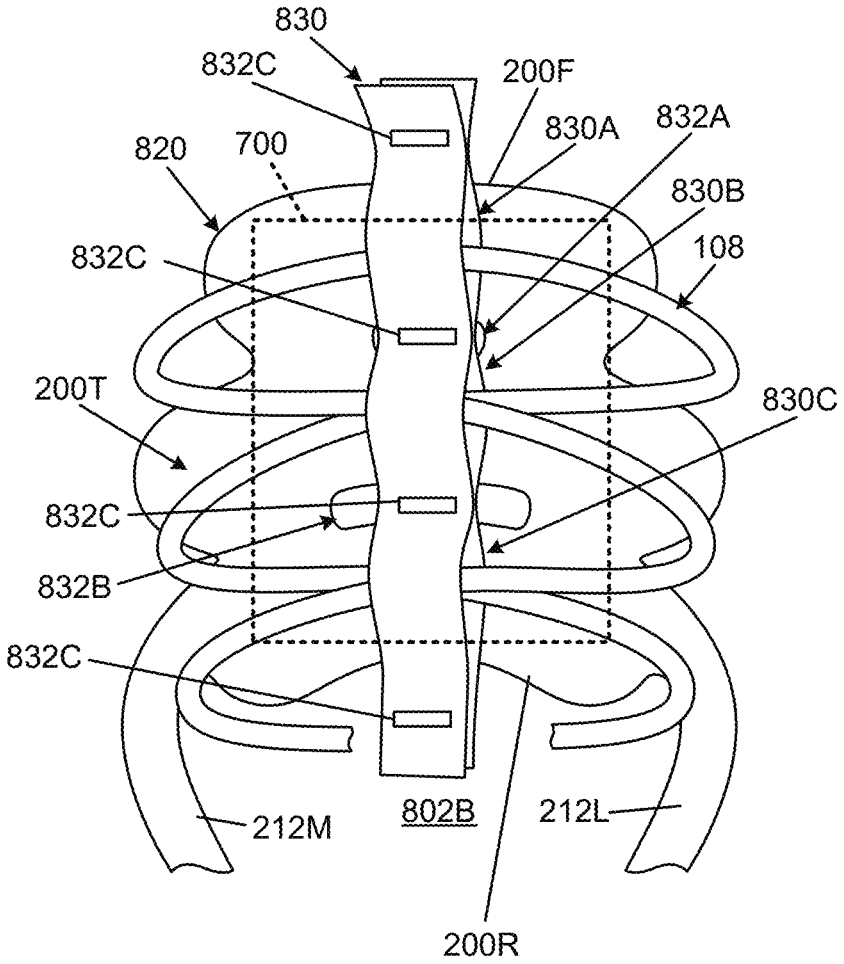
Figure 8D:
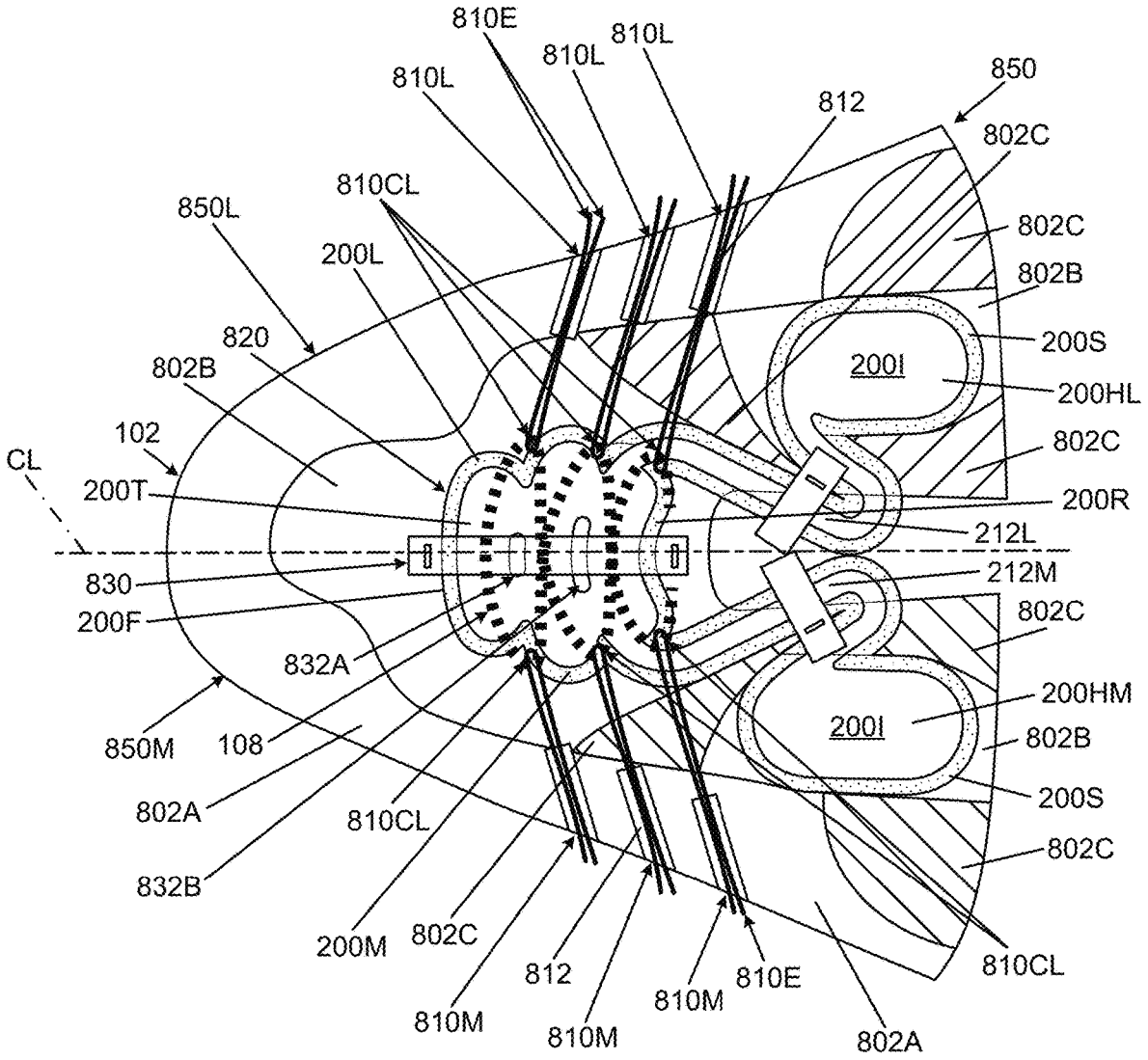
Figure 8E:
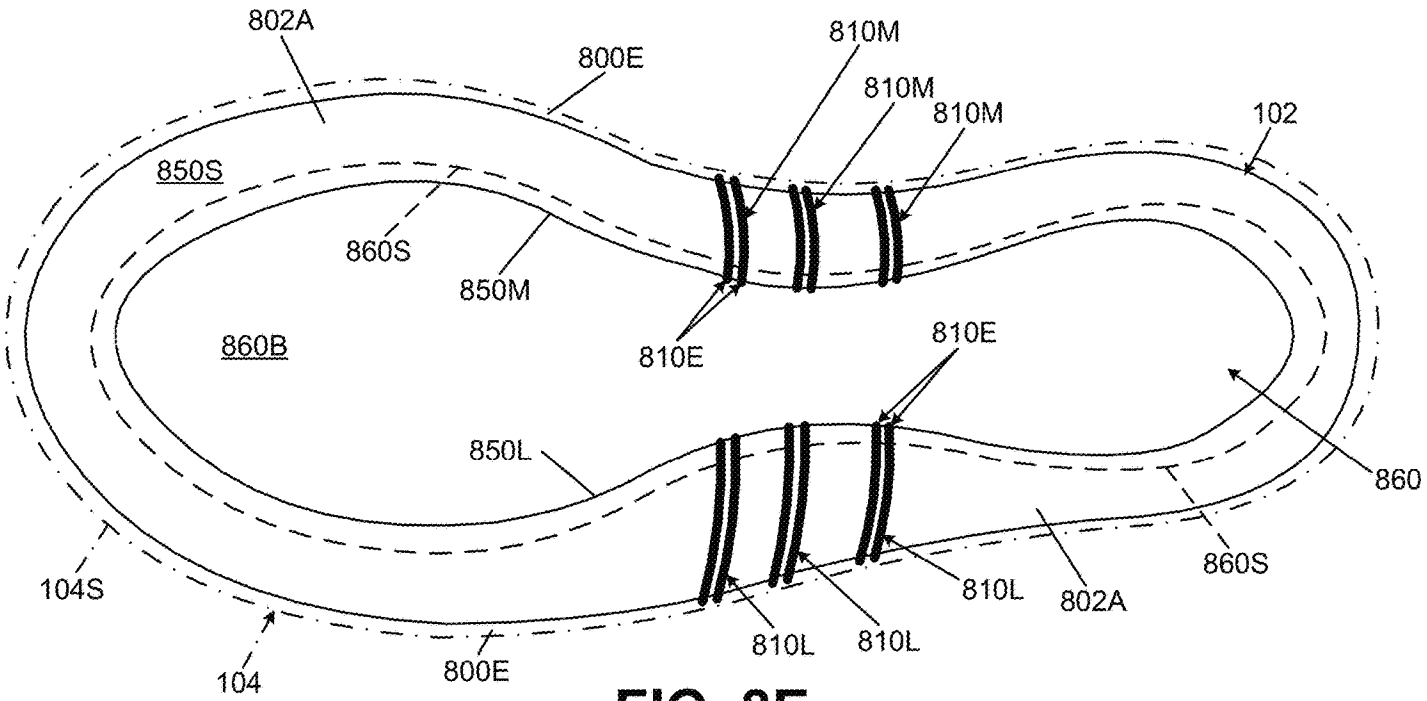
Figure 8F:
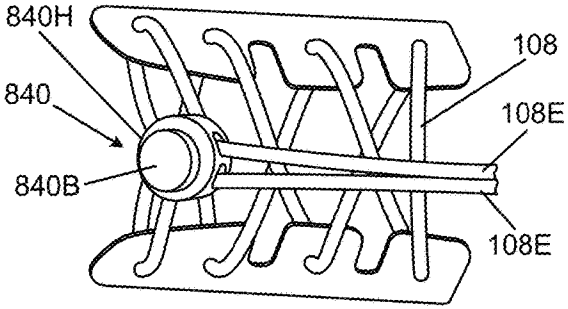

The article of footwear 800 includes a footwear upper base 102 engaged with a sole structure 104. The footwear upper base 102 and sole structure 104 may have any of the features for the footwear upper bases 102 and sole structures 104 described above in conjunction with FIGS. 1-7C. FIG. 8A provides a lateral side view of the article of footwear 800; FIG. 8B provides a medial side view of the article of footwear 800; FIG. 8C provides a view of the bladder 820 and lace 108; FIG. 8D provides a view of the upper blank 800 with the footwear upper base 102 and at least some engaged components; FIG. 8E provides a bottom view of the footwear upper base 102 and at least some engaged components; and FIG. 8F provides a view of a lace securing system.

In the specific examples of FIGS. 8A-8F, the footwear upper base 102 is made from multiple component parts. Any desired parts and/or component materials may be used in footwear upper base 102. In this illustrated example, the bottom perimeter area of the footwear upper base 102 (e.g., where it engages the sole structure 104) is formed from an upper component part 802A made from a relatively dense knit fabric material. The dense knit material is strong and stable to support the connection to sole structure 104 and to handle the incident forces to which that region of the footwear 800 is exposed. A more open mesh knit fabric material is provided as upper component part 802B located inside upper component part 802A in this example. This upper component part 802B enhances breathability and provides a base surface with which at least some portions of the bladder 820 are engaged. In at least some examples of this technology, upper component part 802B may be formed at least in part from a material (e.g., a thermoplastic polyurethane material) that is compatible with the material forming the bladder 820 (e.g., surface 200AX of the bladder 200) so as to enable bonding of the bladder 820 and upper component part 802B in an adhesive free manner. Additionally or alternatively, upper component part 802B and bladder 820 could be engaged by adhesives, connectors, sewn seams, etc. Footwear upper components 802C in this example are made from a relatively stretchy material (e.g., a stretchable knit material, an elastomeric material, etc.). This stretchy material may be provided at locations in the upper to facilitate insertion and removal of the wearer's foot (e.g., at the instep region, around the cuff and top line, at the rear heel area, etc.). Footwear upper base 102 component parts 802A, 802B, 802C may be engaged together in any desired manner, e.g., by sewn seams, by adhesive bonding, by adhesive free bonding, by mechanical connectors or fasteners, etc.

As shown in FIGS. 8A and 8B, article of footwear 800 includes (e.g., as part of the overall footwear upper) at least one lateral lace-engaging component 810L and at least one medial lace-engaging component 810M. While three lateral lace-engaging components 810L and three medial lace-engaging components 810M are shown in FIGS. 8A and 8B, any number of lace-engaging components may be provided on each side of the article of footwear 800, e.g., a plurality, from 2 to 8, from 2 to 6, from 2 to 5, etc. While other structures are possible, in this illustrated example, at least some of the lace-engaging components (one or more of the lateral lace-engaging components 810L and/or one or more of the medial lace-engaging components 810M) may be formed as a flexible strand (e.g., a lateral flexible strand and/or a medial flexible strand). Each of the strand(s) may include two free ends 810E with a central portion extending between the free ends 810E. The strands may be folded so that the central portion forms a central loop 810CL (e.g., a lateral loop and/or a medial loop) for engaging the lace 108. See also FIGS. 8D and 8E. Lace 108 extends across the outer surface of the bladder 820 (e.g., surface 200BX from FIG. 5A) one or more times to engage lace-engaging components 810L, 810M on opposite sides of the bladder 820.

As further shown, the lateral lace-engaging components 810L and medial lace-engaging components 810M of this example (e.g., the flexible strands) extend upward from a bottom lateral edge 850L or region and a bottom medial edge 850M or region, respectively, of the footwear upper base 102 and toward the lateral side and the medial side, respectively, of the bladder 820. Additionally or alternatively, the lateral lace-engaging components 810L and medial lace-engaging components 810M of this example (e.g., the flexible strands) extend upward from a location at or proximate to (within 25 mm) an interface 110I between the footwear upper base 102 and the sole structure 104 toward the lateral instep region and medial instep region, respectively, of the footwear upper base 102 and/or toward the lateral side and the medial side, respectively, of the bladder 820. The term "bottom lateral edge or region" as used herein in this context means the actual lateral edge 850L of the footwear upper base 102, any portion of the lateral side of the footwear upper base 102 located on the top surface of the sole structure 104, any portion of the lateral side of the footwear upper base 102 at the interface 110I of the footwear upper base 102 and the sole structure 104, and/or any portion of the lateral side of the footwear upper base 102 located within 25 mm of the interface 110I. Similarly, the term "bottom medial edge or region" as used herein in this context means the actual medial edge 850M of the footwear upper base 102, any portion of the medial side of the footwear upper base 102 located on the top surface of the sole structure 104, any portion of the medial side of the footwear upper base 102 at the interface 110I of the footwear upper base 102 and the sole structure 104, and/or any portion of the medial side of the footwear upper base 102 located within 25 mm of the interface 110I.

FIGS. 8A, 8B, and 8D further illustrate that the lace-engaging components 810L, 810M of this example article of footwear 800 include a connector 812 through which the flexible strand extends. The connector 812 may hold its respective flexible strand to form the central loop 810CL. The connector 812 may fixedly engage the two end regions of the strand going through it, or the connector 812 may be unfixed to one or both of the end regions of the strand going through it.

FIG. 8E illustrates a bottom of a footwear upper base 102 having its perimeter edge (e.g., including lateral edge 850L and medial edge 850M) engaged with a strobel member 860 (e.g., by stitching 860S). This stitching 860S also may engage the free ends 810E of the lateral lace-engaging components 810L and the medial lace-engaging components 810M with the footwear upper base 102. An outline of the engaging surface (i.e., top surface 104S) of the sole structure 104 is shown by a dot-dash line in FIG. 8E, and this top surface 104S engages at least one of the bottom surface 850S of the footwear upper base 102 and/or the bottom surface 860B of the strobel 860. In this manner, the lateral lace-engaging components 810L and/or the medial lace-engaging components 810M extend along the interfacing surfaces of the footwear upper base 102 and the sole structure 104. Additionally or alternatively, the lateral lace-engaging components 810L and/or the medial lace-engaging components 810M may be engaged with at least one of the footwear upper base 102 and the sole structure 104 at a location spaced inward from an outer perimeter edge 800E of the article of footwear 800 (e.g., at stitching 860S). If the lateral lace-engaging components 810L and/or the medial lace-engaging components 810M are not engaged with the sole structure 104 along surface 104S, this may allow the lateral lace-engaging components 810L and/or the medial lace-engaging components 810M to better conform to and/or wrap the arch area of a wearer's foot when the lace 108 is tightened.

FIG. 8D shows upper blank 850, footwear upper base 102, and bladder 820 having substantially symmetrical constructions, e.g., like upper blank 150, footwear upper base 102, and bladder 200 shown in FIG. 4. The bladder 850 includes: (i) a tongue and/or instep chamber 200T having a first surface (e.g., 200AX from FIG. 7A) and an opposite second surface (e.g., 200BX from FIG. 7A), (ii) at least one heel and/or ankle support chamber (two shown, lateral heel and/or ankle support chamber 200HL and medial heel and/or ankle support chamber 200HM), and (iii) at least one fluid line placing the heel and/or ankle support chamber(s) in fluid communication with the tongue and/or instep chamber 200T. The example of FIG. 8D includes two separate fluid lines: a lateral fluid line 212L placing the lateral heel and/or ankle support chamber 200HL in fluid communication with the tongue and/or instep chamber 200T and a medial fluid line 212M placing the medial heel and/or ankle support chamber 200HM in fluid communication with the tongue and/or instep chamber 200T. Alternatively, if desired, the more symmetric structures of FIG. 8D could be replaced with more asymmetric structures, e.g., like the upper blank 150, footwear upper base 102, and/or bladder 200 structures and/or shapes illustrated in FIGS. 2A-3. In such structures, one of the lateral fluid line 212L or medial fluid line 212M shown in FIG. 8D could be omitted and the lateral heel and/or ankle support chamber 200HL and the medial heel and/or ankle support chamber 200HM could be placed in fluid communication with the tongue and/or instep chamber 200T via a fluid line connecting the lateral heel and/or ankle support chamber 200HL and the medial heel and/or ankle support chamber 200HM (e.g., like fluid line 214 and described in conjunction with FIGS. 2A-3).

As shown in FIGS. 8A, 8B, and 8D, at least a portion of the lateral fluid line 212L and/or medial fluid line 212M may be unsupported by any footwear upper base component 102 along a portion of its length (and thus the unsupported portion(s) of the lateral fluid line 212L and/or medial fluid line 212M consists of only bladder 200 material). In this illustrated example, the footwear upper base 102 defines a foot-receiving opening 106 of the article of footwear 800 (and the footwear upper), and the lateral fluid line 212L and the medial fluid line 212M extend above the foot-receiving opening 106 over at least a portion of a length of the respective fluid line 212L, 212M (when the article of footwear 800 is oriented on a horizontal support surface on the ground-facing surface of its sole structure 104). See areas A1 and A2 in FIGS. 8A and 8B. In some examples of this technology, at least a 10 mm continuous length of the fluid line(s) 212L and/or 212M will be located above the foot-receiving opening 106 and/or will be unsupported by the footwear upper base component(s) 102. This unsupported continuous length of the fluid line(s) 212L and/or 212M may extend at least 15 mm, at least 20 mm, at least 25 mm, or even at least 30 mm in some examples.

The example article of footwear 800 and components thereof shown in FIGS. 8A-8D further include a lace guide 830. The lace guide 830 of this example may be formed from a strip of fabric or other material. As shown in these figures, the lace guide 830 extends along a central region of the tongue and/or instep bladder chamber 200T in a direction from the forward seam region 200F toward the rear seam region 200R of the tongue and/or instep bladder chamber 200T. In some examples of this technology, the lace guide 830 will extend at least from a location at or proximate to a front edge (e.g., forward seam region 200F) of the bladder 820 at least to a location at or proximate to a rear edge (e.g., rear seam region 200R) of the bladder 820 (e.g., the rear seam region 200R of the tongue and/or instep bladder chamber 200T). The term "proximate to" as used herein in this context relating to the location of the lace guide 830 means within 25 mm of the respective seam region and/or edge. The lace guide 830 defines at least a portion of a first channel through which the lace 108 extends. In the illustrated example (e.g., see FIG. 8C), the lace guide 830 defines three lace channels 830A, 830B, 830C spaced apart in the front-to-rear direction. The lace 108 passes through these three channels five times (once through channel 830A, twice through channel 830B, and twice through channel 830C). Other lacing patterns, however, may be used, if desired.

At least a portion of the bladder 820 (e.g., such as surface 200AX (from FIG. 5A) of tongue and/or instep chamber 200T) may be engaged with an upper component (e.g., component 802B), e.g., in an adhesive free manner, using an adhesive bond, using sewing or stitching, using mechanical fasteners or connectors, etc.). As shown in FIGS. 8C and 8D, bladder 820 of this example is formed to include one or more openings defined through it (two openings 832A, 832B shown in the figures). In the illustrated example, the lace guide 830 extends along the outer surface of bladder 820 (e.g., surface 200BX shown in FIG. 5B) and is engaged with the upper component (component 802B) through the opening(s) (e.g., 832A, 832B). A connector 832C (e.g., a sewn seam, a mechanical fastener, etc.) engages the lace guide 830 to the upper component 802B through each of the openings 832A, 832B. Also, in this illustrated example, additional connectors 832C (e.g., sewn seams, mechanical fasteners, etc.) engage the lace guide 830 to the upper component 802B (or another upper component) in front of the forward seam region 200F and behind the rear seam region 200R of the bladder 820. The connectors 832C in this illustrated example at least in part define the channels (e.g., 830A, 830B, 830C) and/or separate the channels from one another. In some examples of this technology, the bladder 820 need not be directly fixed with the footwear upper base 102. Rather, the bladder 820 may be held to the footwear upper base 102 by the connectors 832C joining lace guide 830 to the footwear upper base 102 through openings 832A, 832B and by the other connectors 832C.

FIGS. 8A and 8B show a different type of channel as the forward-most channel 830A as compared to that shown in FIGS. 8C and 8D. In FIGS. 8C and 8D, forward-most channel 830A is formed in part by connectors 832C located forward and rearward. In the example of FIGS. 8A and 8B, on the other hand, forwardmost channel 830A is formed as a loop of the material making up the lace guide 830 (e.g., a strip of fabric material folded around to form a loop). Also, in the example of FIGS. 8C and 8D, the lace guide 830 extends forward somewhat beyond the forward seam region 200F of the bladder 820's tongue and/or instep chamber 200T. In the example of FIGS. 8A and 8B, on the other hand, the forward end of the lace guide 830 is located somewhat rearward of the forward seam region 200F of the bladder 820's tongue and/or instep chamber 200T. Other options for the size, shape, and/or location(s) of the lace guide 830 are possible without departing from this technology.

After passing through the lace-engaging components 810L, 810M on opposite sides of the bladder 820 and extending across the bladder 820 multiple times (e.g., in contact with and/or applying force to bladder 200's outer surface 200BX as shown in FIG. 5A), the lace 108 may be secured in any desired manner. For example, the lace 108 can be tied in a conventional manner (e.g., in a knot). Alternatively, a lace securing system may be provided for holding the lace 108 in a tightened condition. Any desired type of lace securing system may be used, including conventional lace securing systems as are known and used in the footwear arts. In the example of FIGS. 8A, 8B, and 8F, the lace securing system includes a clamp 840 for engaging the lace 108. More specifically, the free ends 108E of the lace 108 extend through a housing 840H of the clamp 840. The clamp 840 of this example includes a spring-loaded button 840B. When the button 840B is pressed against the spring force, the clamp 840 housing 840H can be moved along the lace 108 to tighten or loosen the lace 108 on the wearer's foot. When the button 840B is released, the clamp 840 pinches against the lace 108 within the housing 840H to hold the lace 108 in place with respect to the clamp 840. In this manner, the clamp 840 can hold the lace 108 in a tightened condition around a wearer's foot. Other types of clamps and/or lace securing systems also may be used.

When the lace 108 is placed in the tightened condition, force is applied to the tongue and/or instep bladder chamber 200T by the lace 108. This force moves fluid through fluid lines 212L and 212M to the lateral heel and/or ankle support chamber 200HL and the medial heel and/or ankle support chamber 200HM, e.g., as described above. In some examples of this technology, one or more rigid plates may be provided, e.g., of the types described in conjunction with FIGS. 7A-7C. Such a plate 700 is shown in FIG. 8C in broken lines. The plate(s) 700 may be provided between the lace 108 and the exterior surface of the bladder 820 (e.g., surface 200BX shown in FIGS. 7A-7C). The plate(s) 700 may help moderate the feel of the lace 108 against the wearer's foot and/or may help spread out the force applied to the wearer's foot by the tightened lace 108.

While FIGS. 8A-8F show specific configurations of an article of footwear 800 and various footwear components, such as lace-engaging components 810L, 810M; connectors 812; bladder 820 (and its various portions); lace guide 830; lace securing clamp 840; and upper components 802A-802C, the article of footwear 800 and/or these footwear components may have materially differing appearances in other specific example footwear structures. For example, with respect to the lace-engaging components 810L, 810M, more or fewer could be provided, securing elements other than central loops 810CL could be provided (e.g., hooks, through holes, etc.), the loops 810CL, if provided, may be differently sized, etc. With respect to the connectors 812, different sizes and/or shapes could be provided, different longitudinal lengths could be provided, different colors could be provided, other types of clamps could be provided to define the loop(s) 810CL (e.g., metal clamps, crimped plastic or metal rings, etc.), the connectors 812 could be omitted, etc. With respect to the bladder 820, different bladder sizes and/or shapes could be provided, the bladder may extend further forward or terminate more rearward, the connecting line(s) 212L, 212M may be differently shaped or differently positioned, one or more connecting line(s) 212L, 212M may be omitted, the perimeter seam size may be changed, different internal bonds may be provided (to alter bladder chamber shape), etc. With respect to the lace guide 830, differently sized and shaped lace guides could be used, more or fewer lace channels 830A-830C could be provided, different ways of attaching the lace guide to the upper could be provided, different locations of attachment to the upper could be used, etc. With respect to the lace-securing clamp 840, a differently sized and/or shaped clamp 840 could be provided, a different mechanical clamp mechanism may be used, the clamp 840 could be omitted, e.g., in favor or a traditional tied lace, etc. With respect to the upper components 802A-802C, more or fewer different components may be used, the components may be differently sized and/or shaped (e.g., to begin and/or end at different locations), the components may be differently colored or textured, etc. Thus, the aesthetic appearance of footwear 800, its upper 102, and the individual footwear components may vary widely from the specific examples illustrated.

Figure 9:
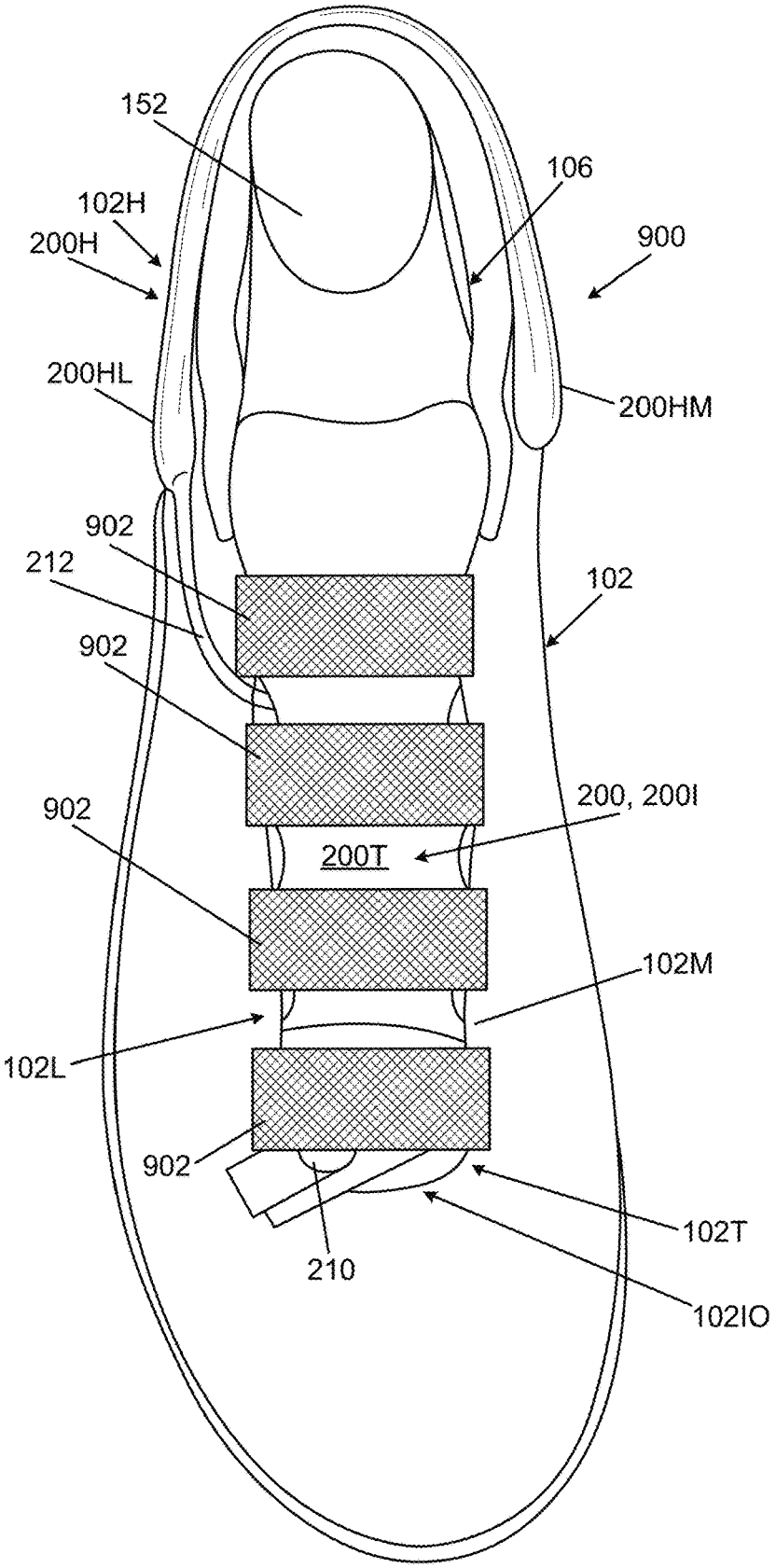
FIG. 9 illustrates another example upper and article of footwear in accordance with some aspects of this technology.

FIG. 9 illustrates another example article of footwear 900 in accordance with at least some aspects of this technology. The view in FIG. 9 is similar to that shown in FIG. 1C. Where the same reference numbers are used in FIG. 9 as used in FIGS. 1A-8F, the same or similar parts are being referred to and much of the corresponding description may be omitted. The following disclosure focuses primarily on differences in the footwear 900 structure of FIG. 9 and the footwear structures described above. All of the above options, alternatives, additional features, etc., described above for the parts shown in FIGS. 1A-8F also may be provided for the same or similar parts shown in FIG. 9.

In the example footwear structure 900 of FIG. 9, the shoelace 108 is replaced with one or more elastic components 902 (e.g., bands) that extend across the instep opening 102IO from the lateral side edge 102L to the medial side edge 102M of the instep opening 102IO. The elastic component(s) 902 may be engaged with the other footwear upper base 102 component(s) and/or with the perimeter seam 200S of the bladder 200 by sewing or stitching, by one or more bonded connections (adhesive or adhesive free), by one or more fasteners, etc. The bladder 200 (located beneath the elastic component(s) 902) may moderate the feel of the elastic component(s) 902 on the wearer's foot. Additionally or alternatively, the one or more elastic components 902 may apply force to the major surface of the bladder 200, e.g., to move fluid to the heel and/or ankle support chamber(s) 200HL, 200HM, e.g., in any of the manners described above. The elastic component(s) 902 also may stretch while the wearer's foot is being inserted and removed to ease in the insertion and removal processes. Any desired number of elastic components 902 may be used (e.g., from 1 to 8, and in some examples, from 1 to 6). The bladder 200 may have any of the constructions described above in conjunction with FIGS. 1A-8F.

In at least some examples of this technology including each of the example structures described above in conjunction with FIGS. 1A-9, one or more of the fluid lines 212, 212L, 212M, and/or 214 may have a transverse cross sectional area of less than 100 $mm^2$, and in some examples, less than 80 $mm^2$, less than 65 $mm^2$, or even less than 50 $mm^2$ over at least a 20 mm length (and in some examples, over at least a 30 mm length, at least a 40 mm length, or even at least a 50 mm length). Additionally or alternatively, in at least some examples of bladders 200 (including any of the bladders described above in conjunction with FIGS. 1A-9), an axial length of one or more of the fluid lines 212, 212L, and/or 212M may be at least 20 mm, and in some examples, at least 30 mm, at least 40 mm, at least 50 mm, at least 60 mm, at least 70 mm, or even at least 80 mm.

Some aspects of this technology are advantageous because the footwear provides additional heel and/or ankle support using a simple system. In at least some examples of this technology, the interior bladder chamber 200I will be completely open to allow free movement of fluid under the applied forces. In the completed and inflated upper/article of footwear in accordance with some examples of this technology, no pumps (manually operated or powered), valves, electronics, and/or complicated and/or expensive mechanical/electrical parts are needed to provide the added heel and/or ankle support. Rather, the additional support can be activated simply by tightening the footwear to the wearer's foot.

While FIGS. 1A-9 illustrate various different bladder sizes, shapes, and specific configurations, many variations in bladder sizes, shapes, and/or configurations are possible without departing from this technology. The specifically illustrated bladders could be varied widely in size, shape, and/or configuration while still providing the desired functions and/or properties described above.

III. Conclusion

The present invention is disclosed above and in the accompanying drawings with reference to a variety of example structures. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A footwear upper, comprising:

a footwear upper base formed from one or more component parts and including an instep region defining an instep opening that includes: (a) a first side edge having a plurality of first side lace-engaging openings defined therethrough and (b) a second side edge having a plurality of second side lace-engaging openings defined therethrough; and a bladder extending across the instep opening from the first side edge to the second side edge, wherein the bladder includes: (i) a first tongue and/or instep chamber, (ii) a first sealed seam region located at the first side edge, and (iii) a second sealed seam region located at the second side edge, wherein the first tongue and/or instep chamber extends between the first sealed seam region and the second sealed seam region, and wherein the first sealed seam region includes a first lace-engaging opening, and wherein the first sealed seam region overlaps with the first side edge of the footwear upper base such that at least a portion of the first lace-engaging opening aligns in an axial direction with at least a portion of a first opening of the plurality of first side lace-engaging openings.

Clause 2. The footwear upper according to Clause 1, wherein the first sealed seam region includes a second lace-engaging opening, and wherein the first sealed seam region overlaps with the first side edge of the footwear upper base such that at least a portion of the second lace-engaging opening aligns in an axial direction with at least a portion of a second opening of the plurality of first side lace-engaging openings.

Clause 3. The footwear upper according to Clause 2, wherein the first sealed seam region is fixedly engaged with the footwear upper base along the first side edge such that the second lace-engaging opening is fixed with respect to the second opening of the plurality of first side lace-engaging openings.

Clause 4. The footwear upper according to Clause 2 or 3, wherein the first sealed seam region includes a third lace-engaging opening, and wherein the first sealed seam region overlaps with the first side edge of the footwear upper base such that at least a portion of the third lace-engaging opening aligns in an axial direction with at least a portion of a third opening of the plurality of first side lace-engaging openings.

Clause 5. The footwear upper according to Clause 4, wherein the first sealed seam region is fixedly engaged with the footwear upper base along the first side edge such that the third lace-engaging opening is fixed with respect to the third opening of the plurality of first side lace-engaging openings.

Clause 6. The footwear upper according to Clause 1, wherein the second sealed seam region includes a second lace-engaging opening, and wherein the second sealed seam region overlaps with the second side edge of the footwear upper base such that at least a portion of the second lace-engaging opening aligns in an axial direction with at least a portion of a first opening of the plurality of second side lace-engaging openings.

Clause 7. The footwear upper according to any one of Clauses 1 to 6, wherein the first sealed seam region is fixedly engaged with the footwear upper base along the first side edge such that the first lace-engaging opening is fixed with respect to the first opening of the plurality of first side lace-engaging openings.

Clause 8. The footwear upper according to any one of Clauses 1 to 7, wherein the first tongue and/or instep chamber includes a first chamber side edge that extends along the first sealed seam region, wherein the first sealed seam region includes a continuous seam that is shaped to form the first chamber side edge as a wave shape.

Clause 9. The footwear upper according to Clause 8, wherein the wave shape of the first chamber side edge includes plural wave peaks, and wherein the first lace-engaging opening of the first sealed seam region and the first opening of the plurality of first side lace-engaging openings are located between two adjacent wave crests of the plural wave peaks.

Clause 10. The footwear upper according to any one of Clauses 1 to 9, wherein the second sealed seam region is not fixedly engaged with the second side edge of the footwear upper base.

Clause 11. The footwear upper according to any one of Clauses 1 to 9, wherein the second sealed seam region is releasably engaged with the second side edge of the footwear upper base.

Clause 12. The footwear upper according to any one of Clauses 1 to 11, wherein the bladder further includes: (i) a heel and/or ankle support chamber, and (ii) a fluid line placing the first tongue and/or instep chamber in fluid communication with the heel and/or ankle support chamber.

Clause 13. The footwear upper according to Clause 12, wherein the fluid line extends between adjacent openings of the plurality of first side lace-engaging openings on the first side edge of the footwear upper base.

Clause 14. The footwear upper according to Clause 12 or 13, wherein the fluid line is located on a lateral side of the footwear upper.

Clause 15. The footwear upper according to any one of Clauses 12 to 14, wherein the heel and/or ankle support chamber includes a lateral heel and/or ankle support chamber.

Clause 16. The footwear upper according to any one of Clauses 12 to 15, wherein the heel and/or ankle support chamber includes a medial heel and/or ankle support chamber.

Clause 17. The footwear upper according to any one of Clauses 12 to 16, wherein a single continuous perimeter seam defines the first tongue and/or instep chamber, the heel and/or ankle support chamber, and the fluid line, and wherein the first sealed seam region and the second sealed seam region form portions of the single continuous perimeter seam.

Clause 18. The footwear upper according to any one of Clauses 12 to 17, wherein force applied to the first tongue and/or instep chamber moves fluid to the heel and/or ankle support chamber via the fluid line to increase fluid volume and/or pressure in the heel and/or ankle support chamber.

Clause 19. The footwear upper according to any one of Clauses 12 to 18, wherein the heel and/or ankle support chamber is located inside at least one of the one or more component parts of the footwear upper base.

Clause 20. The footwear upper according to any one of Clauses 12 to 19, wherein at least a portion of the fluid line is located inside at least one of the one or more component parts of the footwear upper base.

Clause 21. The footwear upper according to any one of Clauses 12 to 20, wherein at least a portion of the first tongue and/or instep chamber is exposed between the first side edge and the second side edge of the footwear upper base.

Clause 22. The footwear upper according to any one of Clauses 12 to 21, further comprising: a lace extending through and between at least some of the plurality of first side lace-engaging openings and at least some of the plurality of second side lace-engaging openings, wherein the lace extends across the first tongue and/or instep chamber of the bladder one or more times and extends through the first lace-engaging opening of the first sealed seam region.

Clause 23. The footwear upper according to Clause 22, wherein the lace applies a force to an exterior surface of the first tongue and/or instep chamber of the bladder and moves fluid to the heel and/or ankle support chamber via the fluid line to increase fluid volume and/or pressure in the heel and/or ankle support chamber.

Clause 24. The footwear upper according to any one of Clauses 12 to 21, further comprising: a lace extending through and between at least some of the plurality of first side lace-engaging openings and at least some of the plurality of second side lace-engaging openings, wherein the lace extends across the first tongue and/or instep chamber of the bladder multiple times, and wherein the lace applies a force to an exterior surface of the first tongue and/or instep chamber of the bladder and moves fluid to the heel and/or ankle support chamber via the fluid line to increase fluid volume and/or pressure in the heel and/or ankle support chamber.

Clause 25. The footwear upper according to any one of Clauses 1 to 11, further comprising: a lace extending through and between at least some of the plurality of first side lace-engaging openings and at least some of the plurality of second side lace-engaging openings, wherein the lace extends across the first tongue and/or instep chamber of the bladder one or more times.

Clause 26. The footwear upper according to Clause 25, wherein the lace applies a force to an exterior surface of the first tongue and/or instep chamber of the bladder.

Clause 27. A footwear upper, comprising:

a footwear upper base formed from one or more component parts;

a bladder including: (i) a first tongue and/or instep chamber located at an instep region of the footwear upper and having a first major surface located in the instep region, (ii) a heel and/or ankle support chamber, and (iii) a fluid line placing the first tongue and/or instep chamber in fluid communication with the heel and/or ankle support chamber; and a lace extending across the first tongue and/or instep chamber of the bladder one or more times and applying force to the first major surface.

Clause 28. The footwear upper according to Clause 27, wherein the fluid line extends between adjacent lace-engaging openings of a plurality of lace-engaging openings provided on a first side of the footwear upper base.

Clause 29. The footwear upper according to Clause 27 or 28, wherein the fluid line is located at a lateral side of the footwear upper.

Clause 30. The footwear upper according to any one of Clauses 27 to 29, wherein the heel and/or ankle support chamber includes a lateral heel and/or ankle support chamber.

Clause 31. The footwear upper according to any one of Clauses 27 to 30, wherein the heel and/or ankle support chamber includes a medial heel and/or ankle support chamber.

Clause 32. The footwear upper according to any one of Clauses 27 to 31, wherein the force applied to the first tongue and/or instep chamber by the lace moves fluid to the heel and/or ankle support chamber via the fluid line to increase fluid volume and/or pressure in the heel and/or ankle support chamber.

Clause 33. The footwear upper according to any one of Clauses 27 to 32, wherein the heel and/or ankle support chamber is located inside at least one of the one or more component parts of the footwear upper base.

Clause 34. The footwear upper according to any one of Clauses 27 to 33, wherein at least a portion of the fluid line is located inside at least one of the one or more component parts of the footwear upper base.

Clause 35. The footwear upper according to any one of Clauses 27 to 34, wherein at least a portion of the first tongue and/or instep chamber is exposed at an exterior of the instep region of the footwear upper.

Clause 36. The footwear upper according to any one of Clauses 27 to 35, wherein a continuous sealed seam extends to define the first tongue and/or instep chamber, the heel and/or ankle support chamber, and the fluid line, and wherein the continuous sealed seam forms an exterior perimeter of the bladder.

Clause 37. The footwear upper according to Clause 36, wherein the continuous sealed seam includes a first lace-engaging opening, wherein at least a portion of the first lace-engaging opening aligns in an axial direction with at least a portion of a first lace-engaging opening defined through the footwear upper base.

Clause 38. The footwear upper according to Clause 37, wherein the continuous sealed seam is fixedly engaged with the footwear upper base such that the first lace-engaging opening of the continuous sealed seam is fixed with respect to the first lace-engaging opening defined through the footwear upper base.

Clause 39. The footwear upper according to Clause 37 or 38, wherein the continuous sealed seam includes a second lace-engaging opening, wherein at least a portion of the second lace-engaging opening aligns in an axial direction with at least a portion of a second lace-engaging opening defined through the footwear upper base.

Clause 40. The footwear upper according to Clause 39, wherein the continuous sealed seam is fixedly engaged with the footwear upper base such that the second lace-engaging opening of the continuous sealed seam is fixed with respect to the second lace-engaging opening defined through the footwear upper base.

Clause 41. The footwear upper according to Clause 39 or 40, wherein the continuous sealed seam includes a third lace-engaging opening, wherein at least a portion of the third lace-engaging opening aligns in an axial direction with at least a portion of a third lace-engaging opening defined through the footwear upper base.

Clause 42. The footwear upper according to Clause 41, wherein the continuous sealed seam is fixedly engaged with the footwear upper base such that the third lace-engaging opening of the continuous sealed seam is fixed with respect to the third lace-engaging opening defined through the footwear upper base.

Clause 43. The footwear upper according to any one of Clauses 36 to 42, wherein the first tongue and/or instep chamber includes a first chamber side edge that extends along the continuous sealed seam, and wherein the continuous sealed seam is shaped to form the first chamber side edge as a wave shape.

Clause 44. The footwear upper according to Clause 43, wherein the wave shape of the first chamber side edge includes plural wave peaks, and wherein a first lace-engaging opening of the footwear upper base and a first lace-engaging opening in the continuous sealed seam are located between two adjacent wave crests of the plural wave peaks.

Clause 45. The footwear upper according to any one of Clauses 36 to 44, wherein one side edge of the first tongue and/or instep chamber formed by the continuous sealed seam is not fixedly engaged with the footwear upper base.

Clause 46. The footwear upper according to any one of Clauses 36 to 45, wherein one side edge of the first tongue and/or instep chamber formed by the continuous sealed seam is releasably engaged with the footwear upper base.

Clause 47. An article of footwear comprising: (i) a footwear upper according to any one of Clauses 1 to 46; and (ii) a sole structure engaged with the footwear upper.

Clause 48. A bladder, comprising:

a first thermoplastic sheet;

a second thermoplastic sheet facing the first thermoplastic sheet; and a continuous outer perimeter seam sealing the first thermoplastic sheet to the second thermoplastic sheet, wherein the continuous outer perimeter seam defines a sealed interior volume between the first thermoplastic sheet and the second thermoplastic sheet, wherein the continuous outer perimeter seam extends continuously to form the sealed interior volume to include: (i) a fluid supply chamber having a first major surface formed by the first thermoplastic sheet, (ii) a first heel and/or ankle support chamber, and (iii) a first fluid line connecting the fluid supply chamber and the first heel and/or ankle support chamber through the sealed interior volume, and wherein a first side edge portion of the continuous outer perimeter seam includes a first lace-engaging opening defined through it.

Clause 49. The bladder according to Clause 48, wherein the continuous outer perimeter seam extends to form a first side edge of the fluid supply chamber as a wave shape.

Clause 50. The bladder according to Clause 49, wherein the wave shape includes plural wave crests, and wherein the first lace-engaging opening is located between two adjacent wave crests.

Clause 51. The bladder according to any one of Clauses 48 to 50, wherein only the continuous outer perimeter seam joins the first thermoplastic sheet and the second thermoplastic sheet.

Clause 52. The bladder according to any one of Clauses 48 to 50, wherein the fluid supply chamber includes one or more welds engaging an interior surface of the first thermoplastic sheet and an interior surface of the second thermoplastic sheet.

Clause 53. The bladder according to any one of Clauses 48 to 52, wherein all portions of the sealed interior volume defined by the first thermoplastic sheet, the second thermoplastic sheet, and the continuous outer perimeter seam are in fluid communication.

Clause 54. The bladder according to any one of Clauses 48 to 53, wherein the first thermoplastic sheet and the second thermoplastic sheet are formed from a single thermoplastic sheet.

Clause 55. The bladder according to any one of Clauses 48 to 54, wherein the first thermoplastic sheet and the second thermoplastic sheet are formed from separate thermoplastic sheets.

Clause 56. The bladder according to any one of Clauses 48 to 55, wherein the fluid supply chamber and the first heel and/or ankle support chamber are in fluid communication by only the first fluid line.

Clause 57. The bladder according to any one of Clauses 48 to 56, further comprising: an inflation port that is permanently sealed after the bladder is inflated, wherein after inflation and sealing, the bladder includes no gas inlet and no gas outlet and contains a fixed mass of gas within the sealed interior volume.

Clause 58. A footwear upper, comprising: (i) a footwear upper base formed from one or more component parts; and (ii) a bladder according to any one of Clauses 48 to 57 engaged with the footwear upper base, wherein the fluid supply chamber is engaged at an instep region of the footwear upper base, and wherein the first heel and/or ankle support chamber is engaged with at least one of a lateral side or a medial side of a heel-containing region of the footwear upper base.

Clause 59. The footwear upper according to Clause 58, wherein the one or more component parts of the footwear upper base includes a first component part, and wherein at least a portion of the bladder is engaged with the first component part in an adhesive free manner.

Clause 60. The footwear upper according to Clause 59, wherein the first component part is a knit component.

Clause 61. The footwear upper according to any one of Clauses 58 to 60, wherein the first fluid line is located on a lateral side of the footwear upper.

Clause 62. The footwear upper according to any one of Clauses 58 to 61, wherein the first heel and/or ankle support chamber includes a lateral heel and/or ankle support chamber located at the lateral side of the heel-containing region of the footwear upper base.

Clause 63. The footwear upper according to any one of Clauses 58 to 61, wherein the first heel and/or ankle support chamber includes a medial heel and/or ankle support chamber located at the medial side of the heel-containing region of the footwear upper base.

Clause 64. The footwear upper according to any one of Clauses 58 to 61, wherein the first heel and/or ankle support chamber includes a lateral heel and/or ankle support chamber and a medial heel and/or ankle support chamber and extends from the lateral side of the heel-containing region of the footwear upper base, around a rear heel region of the footwear upper base, and to the medial side of the heel-containing region of the footwear upper base.

Clause 65. An article of footwear, comprising: (i) a footwear upper according to any one of Clauses 58 to 64; and (ii) a sole structure engaged with the footwear upper.

Clause 66. A footwear upper, comprising:

a footwear upper base formed from one or more component parts and including an instep region;

a first plurality of lace-engaging components located at a first side of the instep region;

a second plurality of lace-engaging components located at a second side of the instep region;

a bladder having at least a portion located at the instep region, wherein the bladder includes: (i) a first tongue and/or instep chamber, (ii) a first sealed seam region extending along a first side edge of the bladder, and (iii) a second sealed seam region extending along a second side edge of the bladder, wherein the first tongue and/or instep chamber extends between the first sealed seam region and the second sealed seam region; and a lace extending through: (a) a first lace-engaging component of the first plurality of lace-engaging components and (b) a first lace-engaging component of the second plurality of lace-engaging components, wherein the lace extends across and applies force to the first tongue and/or instep chamber.

Clause 67. The footwear upper according to Clause 66, wherein the first sealed seam region includes a first lace-engaging opening, and wherein the lace extends through the first lace-engaging opening.

Clause 68. The footwear upper according to Clause 67, wherein the first sealed seam region includes a second lace-engaging opening, wherein the first plurality of lace-engaging components includes a second lace-engaging component, and wherein the lace further extends through the second lace-engaging opening and the second lace-engaging component.

Clause 69. The footwear upper according to Clause 67, wherein the second sealed seam region includes a second lace-engaging opening, wherein the second plurality of lace-engaging components includes a second lace-engaging component, and wherein the lace further extends through the second lace-engaging opening and the second lace-engaging component.

Clause 70. The footwear upper according to any one of Clauses 66 to 69, wherein the bladder further includes: (i) a heel and/or ankle support chamber, and (ii) a fluid line placing the first tongue and/or instep chamber in fluid communication with the heel and/or ankle support chamber.

Clause 71. The footwear upper according to Clause 70, wherein the fluid line extends between adjacent components of the first plurality of lace-engaging components.

Clause 72. The footwear upper according to Clause 70 or 71, wherein the fluid line is located on a lateral side of the footwear upper.

Clause 73. The footwear upper according to any one of Clauses 70 to 72, wherein the heel and/or ankle support chamber includes a lateral heel and/or ankle support chamber.

Clause 74. The footwear upper according to any one of Clauses 70 to 73, wherein the heel and/or ankle support chamber includes a medial heel and/or ankle support chamber.

Clause 75. The footwear upper according to any one of Clauses 70 to 74, wherein a single continuous perimeter seam defines the first tongue and/or instep chamber, the heel and/or ankle support chamber, and the fluid line, and wherein the first sealed seam region and the second sealed seam region form portions of the single continuous perimeter seam.

Clause 76. The footwear upper according to any one of Clauses 70 to 75, wherein force applied to the first tongue and/or instep chamber moves fluid to the heel and/or ankle support chamber via the fluid line to increase fluid volume and/or pressure in the heel and/or ankle support chamber.

Clause 77. The footwear upper according to any one of Clauses 70 to 76, wherein the heel and/or ankle support chamber is located inside at least one of the one or more component parts of the footwear upper base.

Clause 78. The footwear upper according to any one of Clauses 70 to 77, wherein at least a portion of the fluid line is located inside at least one of the one or more component parts of the footwear upper base.

Clause 79. The footwear upper according to any one of Clauses 70 to 78, wherein at least a portion of the first tongue and/or instep chamber is exposed at an exterior surface of the footwear upper.

Clause 80. The footwear upper according to any one of Clauses 70 to 79, wherein the force applied to the first tongue and/or instep chamber by the lace moves fluid to the heel and/or ankle support chamber via the fluid line to increase fluid volume and/or pressure in the heel and/or ankle support chamber.

Clause 81. The footwear upper according to any one of Clauses 66 to 80, wherein the lace extends across the first tongue and/or instep chamber multiple times.

Clause 82. An article of footwear comprising: (i) a footwear upper according to any one of Clauses 66 to 81; and (ii) a sole structure engaged with the footwear upper.

Clause 83. A footwear upper, comprising:

a first lateral lace-engaging component;

a first medial lace-engaging component;

a bladder including: (i) a tongue and/or instep chamber having a first surface and an opposite second surface, (ii) a first heel and/or ankle support chamber, and (iii) a first fluid line placing the first heel and/or ankle support chamber in fluid communication with the tongue and/or instep chamber; and a lace engaging the first lateral lace-engaging component and the first medial lace-engaging component, wherein a first portion of the lace extends across the first surface.

Clause 84. The footwear upper according to Clause 83, wherein the bladder further includes a second heel and/or ankle support chamber in fluid communication with the tongue and/or instep chamber.

Clause 85. The footwear upper according to Clause 83, wherein the bladder further includes a second heel and/or ankle support chamber and a second fluid line placing the second heel and/or ankle support chamber in fluid communication with the tongue and/or instep chamber.

Clause 86. The footwear upper according to Clause 83, further comprising a lace guide extending in a direction from a front edge of the bladder toward a rear edge of the bladder, wherein the lace guide defines at least a portion of a first channel through which the lace extends.

Clause 87. The footwear upper according to Clause 86, further comprising an upper component located adjacent the second surface, wherein a first opening is defined through the bladder, and wherein the lace guide extends along the first surface and is engaged with the upper component through the first opening.

Clause 88. The footwear upper according to any one of Clauses 83 to 87, wherein the first lateral lace-engaging component comprises a first lateral flexible strand that extends from a bottom lateral edge or region of the footwear upper and forms a first lateral loop that engages the lace.

Clause 89. The footwear upper according to any one of Clauses 83 to 88, wherein the first medial lace-engaging component comprises a first medial flexible strand that extends from a bottom medial edge or region of the footwear upper and forms a first medial loop that engages the lace.

Clause 90. The footwear upper according to any one of Clauses 83 to 85, further comprising: (i) a second lateral lace-engaging component; and (ii) a second medial lace-engaging component, wherein the lace further engages the second lateral lace-engaging component and the second medial lace-engaging component.

Clause 91. The footwear upper according to Clause 90, wherein the first lateral lace-engaging component comprises a first lateral flexible strand that extends from a bottom lateral edge or region of the footwear upper and forms a first lateral loop that engages the lace, and wherein the second lateral lace-engaging component comprises a second lateral flexible strand that extends from the bottom lateral edge or region of the footwear upper and forms a second lateral loop that engages the lace.

Clause 92. The footwear upper according to Clause 90 or 91, wherein the first medial lace-engaging component comprises a first medial flexible strand that extends from a bottom medial edge or region of the footwear upper and forms a first medial loop that engages the lace, and wherein the second medial lace-engaging component comprises a second medial flexible strand that extends from the bottom medial edge or region of the footwear upper and forms a second medial loop that engages the lace.

Clause 93. The footwear upper according to any one of Clauses 90 to 92, further comprising a lace guide extending in a direction from a front edge of the bladder toward a rear edge of the bladder, wherein the lace guide defines at least a portion of a first channel through which the lace extends and at least a portion of a second channel through which the lace extends, and wherein the second channel is spaced from the first channel.

Clause 94. The footwear upper according to Clause 93, further comprising an upper component located adjacent the second surface, wherein a first opening and a second opening separate from the first opening are defined through the bladder, and wherein the lace guide extends along the first surface and is engaged with the upper component through the first opening and through the second opening.

Clause 95. The footwear upper according to Clause 94, wherein a first connector engages a first portion of the lace guide with the upper component through the first opening, wherein a second connector engages a second portion of the lace guide with the upper component through the second opening, and wherein the first connector separates the first channel from the second channel.

Clause 96. The footwear upper according to any one of Clauses 83 to 85, further comprising:

a second lateral lace-engaging component;

a second medial lace-engaging component;

a third lateral lace-engaging component; and a third medial lace-engaging component, wherein the lace further engages the second lateral lace-engaging component, the second medial lace-engaging component, the third lateral lace-engaging component, and the third medial lace-engaging component.

Clause 97. The footwear upper according to Clause 96, wherein the first lateral lace-engaging component comprises a first lateral flexible strand that extends from a bottom lateral edge or region of the footwear upper and forms a first lateral loop that engages the lace, wherein the second lateral lace-engaging component comprises a second lateral flexible strand that extends from the bottom lateral edge or region of the footwear upper and forms a second lateral loop that engages the lace, and wherein the third lateral lace-engaging component comprises a third lateral flexible strand that extends from the bottom lateral edge or region of the footwear upper and forms a third lateral loop that engages the lace.

Clause 98. The footwear upper according to Clause 96 or 97, wherein the first medial lace-engaging component comprises a first medial flexible strand that extends from a bottom medial edge or region of the footwear upper and forms a first medial loop that engages the lace, wherein the second medial lace-engaging component comprises a second medial flexible strand that extends from the bottom medial edge or region of the footwear upper and forms a second medial loop that engages the lace, and wherein the third medial lace-engaging component comprises a third medial flexible strand that extends from the bottom medial edge or region of the footwear upper and forms a third medial loop that engages the lace.

Clause 99. The footwear upper according to any one of Clauses 96 to 98, further comprising a lace guide extending in a direction from a front edge of the bladder toward a rear edge of the bladder, wherein the lace guide defines at least a portion of a first channel through which the lace extends, at least a portion of a second channel through which the lace extends, and at least a portion of a third channel through which the lace extends, and wherein the first channel, the second channel, and the third channel are spaced from one another.

Clause 100. The footwear upper according to any one of Clauses 83 to 99, further comprising: a securing system for holding the lace in a tightened condition.

Clause 101. The footwear upper according to any one of Clauses 83 to 99, wherein the lace has a first free end and a second free end opposite the first free end, and wherein the footwear upper further comprises: a clamp engaging the lace proximate to the first free end and proximate to the second free end, the clamp releasably holding the lace in a tightened condition.

Clause 102. The footwear upper according to any one of Clauses 83 to 101, further comprising: a fabric component, wherein at least the bladder is engaged with the fabric component.

Clause 103. The footwear upper according to Clause 102, wherein the bladder is engaged with the fabric component in an adhesive free manner.

Clause 104. An article of footwear, comprising: (i) a footwear upper according to any one of Clauses 83 to 103; and (ii) a sole structure engaged with the footwear upper.

Clause 105. An article of footwear, comprising:

a footwear upper base;

a sole structure engaged with the footwear upper base, the footwear upper base and sole structure defining an interface where the footwear upper base meets the sole structure;

a first lateral lace-engaging component extending from a first lateral location proximate the interface toward a lateral instep region of the footwear upper base;

a first medial lace-engaging component extending from a first medial location proximate the interface toward a medial instep region of the footwear upper base;

a bladder at least partially located between the first lateral lace-engaging component and the first medial lace-engaging component, the bladder including a tongue and/or instep chamber having a first surface and an opposite second surface; and a lace engaging the first lateral lace-engaging component and the first medial lace-engaging component, wherein a first portion of the lace extends across the first surface.

Clause 106. The article of footwear according to Clause 105, wherein the bladder further includes: (i) a first heel and/or ankle support chamber, and (ii) a first fluid line placing the first heel and/or ankle support chamber in fluid communication with the tongue and/or instep chamber.

Clause 107. The article of footwear according to Clause 106, wherein the bladder further includes a second heel and/or ankle support chamber in fluid communication with the tongue and/or instep chamber.

Clause 108. The article of footwear according to Clause 106, wherein the bladder further includes a second heel and/or ankle support chamber and a second fluid line placing the second heel and/or ankle support chamber in fluid communication with the tongue and/or instep chamber.

Clause 109. The article of footwear according to any one of Clauses 105 to 108, further comprising a lace guide extending in a direction from a front edge of the bladder toward a rear edge of the bladder, wherein the lace guide defines at least a portion of a first channel through which the lace extends.

Clause 110. The article of footwear according to Clause 109, wherein a first upper component part of the footwear upper base is located adjacent the second surface, wherein a first opening is defined through the bladder, and wherein the lace guide extends along the first surface and is engaged with the first upper component part through the first opening.

Clause 111. The article of footwear according to any one of Clauses 105 to 110, wherein the first lateral lace-engaging component comprises a first lateral flexible strand that extends from the interface and forms a first lateral loop that engages the lace.

Clause 112. The article of footwear according to Clause 111, wherein the first lateral flexible strand extends along interfacing surfaces of the footwear upper base and the sole structure and is engaged with at least one of the footwear upper base and the sole structure at a location spaced inward from an outer perimeter edge of the article of footwear.

Clause 113. The article of footwear according to any one of Clauses 105 to 112, wherein the first medial lace-engaging component comprises a first medial flexible strand that extends from the interface and forms a first medial loop that engages the lace.

Clause 114. The article of footwear according to Clause 113, wherein the first medial flexible strand extends along interfacing surfaces of the footwear upper base and the sole structure and is engaged with at least one of the footwear upper base and the sole structure at a location spaced inward from an outer perimeter edge of the article of footwear.

Clause 115. The article of footwear according to any one of Clauses 105 to 108, further comprising: (i) a second lateral lace-engaging component; and (ii) a second medial lace-engaging component, wherein the lace further engages the second lateral lace-engaging component and the second medial lace-engaging component.

Clause 116. The article of footwear according to Clause 115, wherein the first lateral lace-engaging component comprises a first lateral flexible strand that extends from the first lateral location proximate the interface and forms a first lateral loop that engages the lace, and wherein the second lateral lace-engaging component comprises a second lateral flexible strand that extends from a second lateral location proximate the interface toward the lateral instep region and forms a second lateral loop that engages the lace.

Clause 117. The article of footwear according to Clause 116, wherein the first lateral flexible strand extends along interfacing surfaces of the footwear upper base and the sole structure and is engaged with at least one of the footwear upper base and the sole structure at a location spaced inward from an outer perimeter edge of the article of footwear, and wherein the second lateral flexible strand extends along interfacing surfaces of the footwear upper base and the sole structure and is engaged with at least one of the footwear upper base and the sole structure at a location spaced inward from the outer perimeter edge of the article of footwear.

Clause 118. The article of footwear according to any one of Clauses 115 to 117, wherein the first medial lace-engaging component comprises a first medial flexible strand that extends from the first medial location proximate the interface and forms a first medial loop that engages the lace, and wherein the second medial lace-engaging component comprises a second medial flexible strand that extends from a second medial location proximate the interface and forms a second medial loop that engages the lace.

Clause 119. The article of footwear according to Clause 118, wherein the first medial flexible strand extends along interfacing surfaces of the footwear upper base and the sole structure and is engaged with at least one of the footwear upper base and the sole structure at a location spaced inward from an outer perimeter edge of the article of footwear, and wherein the second medial flexible strand extends along interfacing surfaces of the footwear upper base and the sole structure and is engaged with at least one of the footwear upper base and the sole structure at a location spaced inward from the outer perimeter edge of the article of footwear.

Clause 120. The article of footwear according to any one of Clauses 115 to 119, further comprising a lace guide extending in a direction from a front edge of the bladder toward a rear edge of the bladder, wherein the lace guide defines at least a portion of a first channel through which the lace extends and at least a portion of a second channel through which the lace extends, and wherein the second channel is spaced from the first channel.

Clause 121. The article of footwear according to Clause 120, wherein a first upper component part of the footwear upper base is located adjacent the second surface, wherein a first opening and a second opening separate from the first opening are defined through the bladder, and wherein the lace guide extends along the first surface and is engaged with the first upper component part through the first opening and through the second opening.

Clause 122. The article of footwear according to Clause 121, wherein a first connector engages a first portion of the lace guide with the first upper component part through the first opening, wherein a second connector engages a second portion of the lace guide with the first upper component part or another upper component part through the second opening, and wherein the first connector separates the first channel from the second channel.

Clause 123. The article of footwear according to any one of Clauses 105 to 108, further comprising: (i) a second lateral lace-engaging component; (ii) a second medial lace-engaging component; (iii) a third lateral lace-engaging component; and (iv) a third medial lace-engaging component, wherein the lace further engages the second lateral lace-engaging component, the second medial lace-engaging component, the third lateral lace-engaging component, and the third medial lace-engaging component.

Clause 124. The article of footwear according to Clause 123, wherein the first lateral lace-engaging component comprises a first lateral flexible strand that extends from the first lateral location proximate the interface and forms a first lateral loop that engages the lace, wherein the second lateral lace-engaging component comprises a second lateral flexible strand that extends from a second lateral location proximate the interface and forms a second lateral loop that engages the lace, and wherein the third lateral lace-engaging component comprises a third lateral flexible strand that extends from a third lateral location proximate the interface and forms a third lateral loop that engages the lace.

Clause 125. The article of footwear according to Clause 124, wherein the first lateral flexible strand extends along interfacing surfaces of the footwear upper base and the sole structure and is engaged with at least one of the footwear upper base and the sole structure at a location spaced inward from an outer perimeter edge of the article of footwear, wherein the second lateral flexible strand extends along interfacing surfaces of the footwear upper base and the sole structure and is engaged with at least one of the footwear upper base and the sole structure at a location spaced inward from the outer perimeter edge of the article of footwear, and wherein the third lateral flexible strand extends along interfacing surfaces of the footwear upper base and the sole structure and is engaged with at least one of the footwear upper base and the sole structure at a location spaced inward from the outer perimeter edge of the article of footwear.

Clause 126. The article of footwear according to any one of Clauses 123 to 125, wherein the first medial lace-engaging component comprises a first medial flexible strand that extends from the first medial location proximate the interface and forms a first medial loop that engages the lace, wherein the second medial lace-engaging component comprises a second medial flexible strand that extends from a second medial location proximate the interface and forms a second medial loop that engages the lace, and wherein the third medial lace-engaging component comprises a third medial flexible strand that extends from a third medial location proximate the interface and forms a third medial loop that engages the lace.

Clause 127. The article of footwear according to Clause 126, wherein the first medial flexible strand extends along interfacing surfaces of the footwear upper base and the sole structure and is engaged with at least one of the footwear upper base and the sole structure at a location spaced inward from an outer perimeter edge of the article of footwear, wherein the second medial flexible strand extends along interfacing surfaces of the footwear upper base and the sole structure and is engaged with at least one of the footwear upper base and the sole structure at a location spaced inward from the outer perimeter edge of the article of footwear, and wherein the third medial flexible strand extends along interfacing surfaces of the footwear upper base and the sole structure and is engaged with at least one of the footwear upper base and the sole structure at a location spaced inward from the outer perimeter edge of the article of footwear.

Clause 128. The article of footwear according to any one of Clauses 123 to 127, further comprising a lace guide extending in a direction from a front edge of the bladder toward a rear edge of the bladder, wherein the lace guide defines at least a portion of a first channel through which the lace extends, at least a portion of a second channel through which the lace extends, and at least a portion of a third channel through which the lace extends, and wherein the first channel, the second channel, and the third channel are spaced from one another.

Clause 129. The article of footwear according to Clause 128, wherein a first upper component part of the footwear upper base is located adjacent the second surface, wherein a first opening and a second opening separate from the first opening are defined through the bladder, and wherein the lace guide extends along the first surface and is engaged with the first upper component part through the first opening and through the second opening.

Clause 130. The article of footwear according to Clause 129, wherein a first connector engages a first portion of the lace guide with the first upper component part through the first opening, wherein a second connector engages a second portion of the lace guide with the first upper component part or another upper component part through the second opening, and wherein the first connector separates the first channel from the second channel.

Clause 131. The article of footwear according to any one of Clauses 105 to 130, further comprising: a securing system for holding the lace in a tightened condition.

Clause 132. The article of footwear according to any one of Clauses 105 to 130, wherein the lace has a first free end and a second free end opposite the first free end, and wherein the article of footwear further comprises: a clamp engaging the lace proximate to the first free end and proximate to the second free end, the clamp releasably holding the lace in a tightened condition.

Clause 133. The article of footwear according to any one of Clauses 105 to 132, wherein the footwear upper base includes a fabric component, wherein at least the bladder is engaged with the fabric component.

Clause 134. The article of footwear according to Clause 133, wherein the bladder is engaged with the fabric component in an adhesive free manner.

What is claimed is:

1. An article of footwear, comprising:

a footwear upper base formed from one or more component parts and having a topmost edge that defines a foot-receiving opening into the article of footwear;

a sole structure engaged with the footwear upper base, the footwear upper base and sole structure defining an interface where the footwear upper base meets the sole structure, wherein the sole structure includes a ground-facing surface;

a first lateral lace-engaging component extending from a first lateral location proximate the interface toward a lateral instep region of the footwear upper base, wherein the first lateral lace-engaging component comprises a first lateral flexible strand;

a first medial lace-engaging component extending from a first medial location proximate the interface toward a medial instep region of the footwear upper base, wherein the first medial lace-engaging component comprises a first medial flexible strand;

a bladder located between the first lateral lace-engaging component and the first medial lace-engaging component, the bladder including: (a) a tongue and/or instep chamber having a first surface and an opposite second surface, (b) a first heel and/or ankle support chamber, and (c) a first fluid line placing the first heel and/or ankle support chamber in fluid communication with the tongue and/or instep chamber, wherein at least a portion of a length of the first fluid line extends upward beyond the foot-receiving opening when the article of footwear is oriented on a horizontal support surface on the ground-facing surface of the sole structure; and a lace engaging the first lateral lace-engaging component and the first medial lace-engaging component, wherein a first portion of the lace extends from the first lateral lace-engaging component to the first medial lace-engaging component and over the first surface of the tongue and/or instep chamber.

2. The article of footwear according to claim 1, wherein the bladder further includes a second heel and/or ankle support chamber in fluid communication with the tongue and/or instep chamber.

3. The article of footwear according to claim 1, wherein the bladder further includes a second heel and/or ankle support chamber and a second fluid line placing the second heel and/or ankle support chamber in fluid communication with the tongue and/or instep chamber.

4. The article of footwear according to claim 1, wherein the first lateral flexible strand forms a first lateral loop through which the lace extends, and wherein the first medial flexible strand forms a first medial loop through which the lace extends.

5. The article of footwear according to claim 4, wherein the first lateral flexible strand extends along interfacing surfaces of the footwear upper base and the sole structure and is engaged with at least one of the footwear upper base and the sole structure at a first location spaced inward from an outer perimeter edge of the article of footwear, and wherein the first medial flexible strand extends along interfacing surfaces of the footwear upper base and the sole structure and is engaged with at least one of the footwear upper base and the sole structure at a second location spaced inward from the outer perimeter edge of the article of footwear.

6. The article of footwear according to claim 1, further comprising:

a second lateral lace-engaging component extending from a second lateral location proximate the interface toward the lateral instep region, wherein the second lateral lace-engaging component comprises a second lateral flexible strand; and a second medial lace-engaging component extending from a second medial location proximate the interface toward the medial instep region, wherein the second medial lace-engaging component comprises a second medial flexible strand.

7. The article of footwear according to claim 6, wherein the first lateral flexible strand forms a first lateral loop, wherein the second lateral flexible strand forms a second lateral loop, wherein the first medial flexible strand forms a first medial loop, wherein the second medial flexible strand forms a second medial loop, and wherein the lace extends through each of the first lateral loop, the first medial loop, the second lateral loop, and the second medial loop.

8. The article of footwear according to claim 1, further comprising:

a second lateral lace-engaging component extending from a second lateral location proximate the interface toward the lateral instep region, wherein the second lateral lace-engaging component comprises a second lateral flexible strand;

a third lateral lace-engaging component extending from a third lateral location proximate the interface toward the lateral instep region, wherein the third lateral lace-engaging component comprises a third lateral flexible strand;

a second medial lace-engaging component extending from a second medial location proximate the interface toward the medial instep region, wherein the second medial lace-engaging component comprises a second medial flexible strand; and a third medial lace-engaging component extending from a third medial location proximate the interface toward the medial instep region, wherein the third medial lace-engaging component comprises a third medial flexible strand.

9. The article of footwear according to claim 8, wherein the first lateral flexible strand forms a first lateral loop, wherein the second lateral flexible strand forms a second lateral loop, wherein the third lateral flexible strand forms a third lateral loop, wherein the first medial flexible strand forms a first medial loop, wherein the second medial flexible strand forms a second medial loop, wherein the third medial flexible strand forms a third medial loop, and wherein the lace extends through each of the first lateral loop, the first medial loop, the second lateral loop, the second medial loop, the third lateral loop, and the third medial loop.

10. The article of footwear according to claim 1, further comprising:

a securing system for holding the lace in a tightened condition.

11. The article of footwear according to claim 1, wherein the footwear upper base includes a fabric component, wherein the bladder is engaged with the fabric component in an adhesive free manner.

12. The article of footwear according to claim 1, further comprising:

a plate provided between the lace and the first surface of the tongue and/or instep chamber.

13. The article of footwear according to claim 12, wherein a lace-engaging hole is defined through the plate, and wherein the lace additionally extends through the lace-engaging hole.

14. The article of footwear according to claim 12, wherein the bladder further includes a second heel and/or ankle support chamber in fluid communication with the tongue and/or instep chamber.

15. The article of footwear according to claim 12, wherein the bladder further includes a second heel and/or ankle support chamber and a second fluid line placing the second heel and/or ankle support chamber in fluid communication with the tongue and/or instep chamber.

16. A footwear upper, comprising:

a footwear upper base formed from one or more component parts;

a bladder including a tongue and/or instep chamber located at an instep region of the footwear upper;

a plate overlaying an exterior surface of the tongue and/or instep chamber of the bladder in the instep region, wherein a lace-engaging hole is defined through the plate; and a lace extending through the lace-engaging hole and across the plate, wherein the plate is located between the lace and the exterior surface of the tongue and/or instep chamber, and wherein the lace, when tightened, applies a force to the plate and to the exterior surface.

17. The footwear upper according to claim 16, wherein the bladder further includes: (i) a first heel and/or ankle support chamber, and (ii) a first fluid line placing the first heel and/or ankle support chamber in fluid communication with the tongue and/or instep chamber.

18. The footwear upper according to claim 17, wherein the bladder further includes a second heel and/or ankle support chamber in fluid communication with the tongue and/or instep chamber.

19. The footwear upper according to claim 17, wherein the bladder further includes a second heel and/or ankle support chamber and a second fluid line placing the second heel and/or ankle support chamber in fluid communication with the tongue and/or instep chamber.

20. The footwear upper according to claim 16, wherein the plate is one of a plurality of plates, wherein each plate of the plurality of plates: (a) is spaced apart from adjacent plates of the plurality of plates, (b) is interconnected with at least one other plate of the plurality of plates by a flexible connector, and (c) overlays a portion of an exterior surface of the tongue and/or instep chamber of the bladder in the instep region, and wherein the lace extends across at least some of the plurality of plates, wherein said at least some of the plurality of plates are located between the lace and the exterior surface of the tongue and/or instep chamber, and wherein the lace, when tightened, applies a force to said at least some of the plurality of plates and to the exterior surface.

* * * * *